US007755516B2

(12) United States Patent
Clark et al.

(10) Patent No.: US 7,755,516 B2
(45) Date of Patent: Jul. 13, 2010

(54) TRAFFIC DISPLAY SYSTEM, AIRCRAFT INCLUDING THE DISPLAY SYSTEM AND METHOD OF DISPLAYING OFF-SCALE TRAFFIC IN THE DISPLAY SYSTEM

(75) Inventors: Samuel T. Clark, Federal Way, WA (US); Roglenda R. Bowe, Maple Valley, WA (US); Taji Shafaat, Everett, WA (US); Michael P. Snow, Langley, WA (US)

(73) Assignee: The Boeing Company, Chicago, IL (US)

( * ) Notice: Subject to any disclaimer, the term of this patent is extended or adjusted under 35 U.S.C. 154(b) by 354 days.

(21) Appl. No.: 11/841,453

(22) Filed: Aug. 20, 2007

(65) Prior Publication Data

US 2009/0051570 A1 Feb. 26, 2009

(51) Int. Cl.
*G08G 5/04* (2006.01)

(52) U.S. Cl. ..... 340/961; 340/958; 340/972; 701/14

(58) Field of Classification Search ..... 340/933, 340/980, 945–972; 701/3, 9–16, 120, 301; 342/357.17, 29, 36
See application file for complete search history.

(56) References Cited

U.S. PATENT DOCUMENTS

| | | | | |
|---|---|---|---|---|
| 5,629,691 | A * | 5/1997 | Jain | 340/961 |
| 5,867,804 | A * | 2/1999 | Pilley et al. | 701/120 |
| 7,308,343 | B1 * | 12/2007 | Horvath et al. | 701/3 |
| 7,564,372 | B1 * | 7/2009 | Bailey et al. | 340/961 |
| 2005/0190079 | A1 * | 9/2005 | He | 340/945 |
| 2006/0214816 | A1 * | 9/2006 | Schell | 340/961 |

* cited by examiner

*Primary Examiner*—Brent Swarthout
(74) *Attorney, Agent, or Firm*—Law Office of Charles W. Peterson, Jr.

(57) ABSTRACT

A aircraft traffic display system, aircraft including the display system and a method of displaying aircraft and vehicle traffic in the display system. The system includes an ownship location finder determining ownship location and maps, including airport maps stored in map storage. A traffic information collector collecting information on airport and other traffic. A local display displays ownship on a moving map at a selected range and all airport traffic within range, or a filtered subset thereof. An off-scale traffic processor monitors off-scale traffic beyond the selected range and identifies of-interest off-scale traffic. The local display also provides an indication of any of interest off-scale traffic. The indication may visibly indicate status (e.g., air or ground) of respective said off-scale traffic and may include traffic specific information.

47 Claims, 17 Drawing Sheets

TRAFFIC DISPLAY SYSTEM, AIRCRAFT INCLUDING THE DISPLAY SYSTEM AND METHOD OF DISPLAYING OFF-SCALE TRAFFIC IN THE DISPLAY SYSTEM

CROSS REFERENCE TO RELATED APPLICATION

The disclosure is related to U.S. Pat. No. 7,222,017, entitled "METHOD AND SYSTEM FOR ENTERING AND DISPLAYING GROUND TAXI INSTRUCTIONS," to Samuel T. Clark et al., filed Jun. 17, 2004, and issued May 22, 2007; to U.S. patent application Ser. No. 11/555,884, entitled "Runway Status Indication and Traffic Information Display and Filtering," to Samuel T. Clark et al., filed Nov. 2, 2006; and to U.S. patent application Ser. No. 11/744,671, entitled "AutoRange for Electronic Airport Moving Map," to Samuel T. Clark et al., filed May 4, 2007; all assigned to the assignee of the present application and incorporated herein by reference.

BACKGROUND

1. Technical Field

The embodiments of the disclosure generally relate to on-board aircraft displays and, more particularly, to aircraft on-board navigation and supplemental situational awareness displays that display aircraft and vehicle traffic at an airport, e.g., for awareness during taxi, takeoff, approach and landing, or that display enroute or terminal area aircraft traffic for maneuvering (e.g., sequencing, merging, or passing) or alerting.

2. Background Description

Aircraft cockpit displays are continually being enhanced with features that promote safety and efficiency. Modern aircraft may include advanced feature navigation and supplemental information displays including, for example, an Electronic Airport Moving Map (EAMM) or a moving map display.

A typical moving map may display the surface features (e.g., representing buildings, ramps, runways, taxiways, bodies of water, and fields) of a particular airport and, further, display ownship position (i.e., self) on the map. The moving map may include overlays of, for example, a cleared taxi route, changes to normal operations, Automatic Terminal Information Service (ATIS) and NOtices To AirMen (NOTAM) information, runway status, traffic, runway exit information, and alerting information. The map display also may provide runway and traffic related dynamic information. Such dynamic information may include, for example, traffic position and movement, runway status (occupancy and use), traffic conflicts, and optimized runway exit information. Thus, moving maps are especially helpful for keeping flight crew apprised of local conditions in the immediate vicinity of an aircraft during taxi, takeoff, and approach and landing. Similarly, away from the airport the enroute and terminal area display of traffic and off-scale traffic information on a moving map in-flight also provides useful and important crew awareness.

State of the art flight deck displays provide the flight crew with little, if any, normal or non-normal airport traffic related situational information. For traffic situational awareness the flight crew relies on outside visual information and radio communications, primarily with the airport traffic control. In-flight, the Traffic alert and Collision Avoidance System (TCAS) provides airborne traffic alerts, as well as other routine/normal (non-alert) airborne traffic situational awareness. TCAS does not provide traffic alerts below a certain altitude or typically display ground traffic. Currently, off-scale and so, off-display traffic information is provided as a non-specific, generic, alphanumeric off-scale traffic text, only in air, and only for airborne traffic alerts. While these off-scale traffic text alerts may generally make the flight crew aware that traffic is off-scale, the text does not provide any specific indication or information of the off-scale traffic—e.g., traffic bearing, speed, distance and time to intersection point. Moreover, off-scale traffic text alerts provide no awareness of on or off scale ground traffic and, in particular, no awareness alerts for off-scale ground or low altitude (on approach or taking off) traffic.

For example, the flight crew may be totally unaware of off-screen traffic that may pose an actual or potential conflict; or unable to monitor off-screen traffic upon which ownship clearance is predicated. During taxi operations, flight crews typically focus primarily on close or local map features, e.g., with the 0.5 nautical mile (0.5 nm) or 1 nm airport map range selected for the moving map display. Awareness of off-scale ground and approaching air traffic, beyond that 0.5 or 1 nm range, promotes safe and efficient ownship operation. When off-scale ground and air traffic is beyond what the flight crew has selected for the current display range; the flight crew may be unaware of this off-scale traffic until sometime after the off-scale traffic enters the display range. Consequently, when the off-scale traffic enters the display range (and, so, is no longer off-scale traffic), the flight crew has less time to become aware and react. Thus, for this previously off-scale traffic, particularly fast moving traffic, there may be little or insufficient time for the crew to plan and execute a response.

Accordingly, there is a need in the art for providing flight crew with relevant information of off-scale traffic to significantly improve flight crew awareness and enhance both safe and efficient ownship operations.

SUMMARY

An advantageous embodiment includes an aircraft traffic display system, aircraft including the display system and a method of displaying aircraft and vehicle traffic in the display system. The system includes; an ownship location finder determining ownship location and maps, including airport maps stored in map storage; a traffic information collector collecting information on airport and other traffic; a local display displays ownship on a moving map at a selected range and all traffic within range, or a filtered subset thereof, and an off-scale traffic processor which monitors off-scale traffic beyond the selected range and identifies of-interest, said off-scale traffic. The local display also provides an indication of any of-interest off-scale traffic. The indication may visibly indicate status (e.g., air or ground) of respective said off-scale traffic and may include traffic specific information, e.g., identification, bearing, heading/track, speed, acceleration, distance and time from intersection.

Advantageously, on ground and in-flight, the present invention provides flight crew with indications of whether off scale traffic is "coupled" with ownship, is an aircraft the crew has "selected" for additional information, or is an aircraft that is issuing, causing, or may cause an alert, or is generating other types of relevant information. The present invention combines data/information on ownship and traffic with maps, including airport maps, and pilot inputs to automatically and continuously evaluate traffic information received, e.g., by datalink, ADS-B (automatic dependent surveillance-broadcast) or otherwise, to filter off-scale aircraft and identify traffic that is or may be relevant to safe and efficient ownship operation. The off-scale traffic indication may be graphical, alphanumeric, or a combination of graphical and alphanumeric, and may be accompanied by an aural indication, e.g., voice or tone. Further, the off-scale traffic indication may be accompanied by specific traffic information. Thus, the flight crew experiences enhanced awareness of off-scale traffic relevant to ownship operation to significantly reduce flight crew workload related to traffic monitoring, detection, and interpretation.

The features, functions, and advantages can be achieved independently in various embodiments of the present inventions or may be combined in yet other embodiments.

BRIEF DESCRIPTION OF THE DRAWINGS

The foregoing and other objects, aspects and advantages will be better understood from the following detailed description of a preferred embodiment of the disclosure with reference to the drawings, in which.

DETAILED DESCRIPTION

Figure 1:
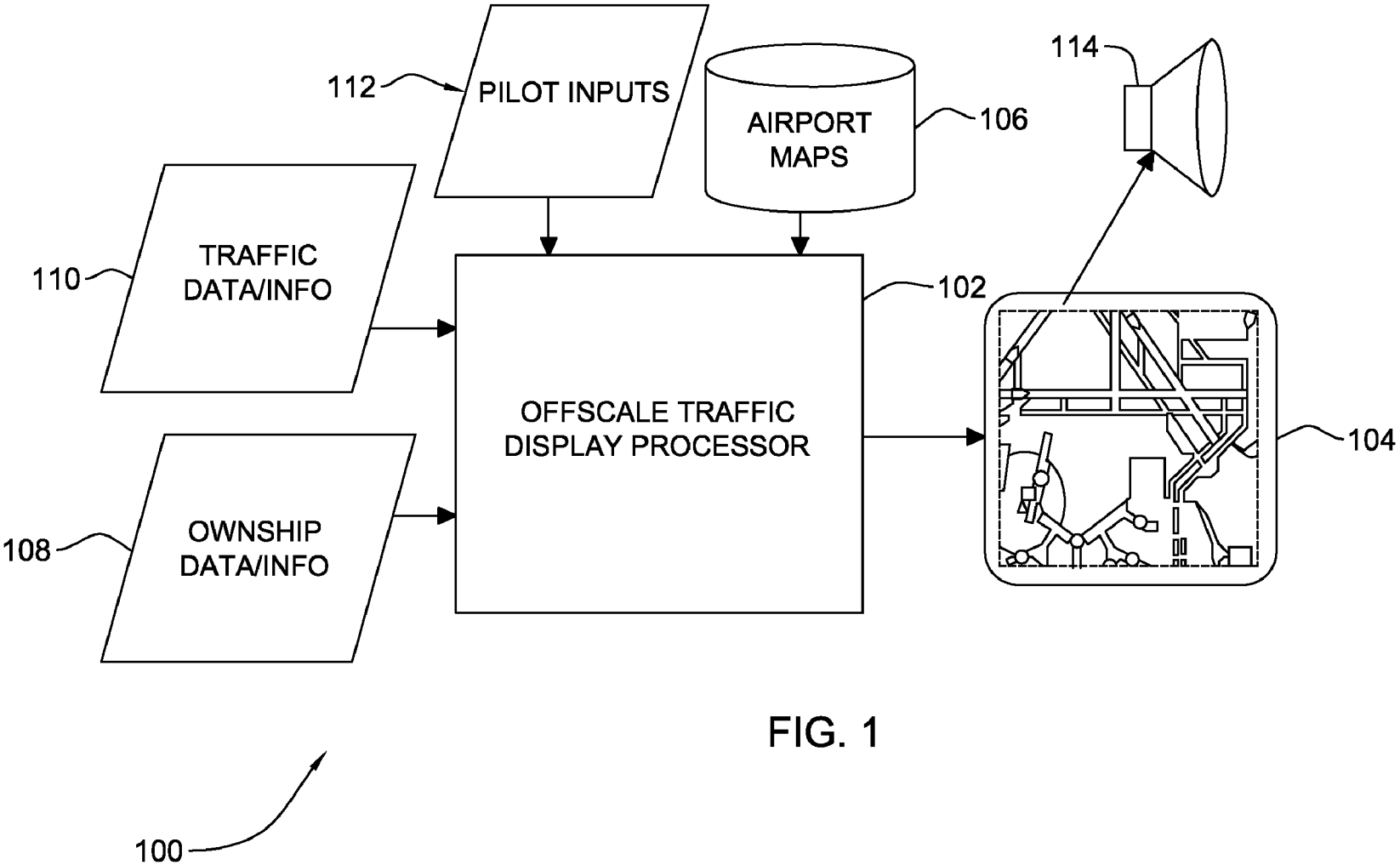
FIG. 1 illustrates an example of a system that automatically, or by previous manual or other pilot selection/designation, determines which off-scale traffic is relevant to current ownship operations and displays such relevant off-scale traffic according to an advantageous embodiment of the present invention.

Turning now to the drawings, FIG. 1 illustrates an example of a system 100 that automatically, or by previous manual or other pilot selection/designation, determines which off-scale traffic is relevant to current ownship status/operations; and displays and indication of such relevant off-scale traffic that is presently of interest according to an advantageous embodiment of the present invention. Recently conducted simulations and testing have highlighted the need for traffic display filtering and enhancement, and off-scale traffic display. Displaying unfiltered and un-enhanced traffic information is not feasible because it clutters the display with unnecessary information. On a large busy airport, the number of aircraft displayed can be quite large. At any point, only a few other aircraft are relevant and even fewer are of interest (e.g., can conflict with ownship or are of other interest). However, displaying all relevant traffic within range unfiltered, makes discerning the few relevant aircraft that are of interest more difficult. Similarly, displaying off-scale indication for all off-scale traffic may unnecessarily clutter the display and make discerning the few of interest from the relevant off-scale aircraft more difficult.

So, situational awareness of traffic in general, and actual or potential traffic conflicts is highly desirable—especially for traffic that is off-display. For example, it is desirable to keep crew aware of aircraft and ground vehicles that are beyond the aircraft's currently selected moving map range, i.e., off-display traffic. More particularly, it is desirable to display real time off-scale traffic identification, speed, altitude, bearing, time, and distance from intersection or from ownship information, during taxi, takeoff, the latter stages of approach/landing, and during enroute and terminal area in-flight operation. Thus, the advantageous embodiment of system 100 provides more robust full featured situational information (e.g., with traffic filtering, enhancement/highlight, and off-scale traffic awareness) to significantly reduce the burden on the flight crew and improve situational awareness, facilitating safe and efficient taxi, takeoff, approach/landing and other operations.

Thus, a preferred system 100 includes a processor 102 suitable for receiving and processing inputs and information, e.g., on local airport geographic and traffic conditions, and generating a representation (e.g., as graphical and alphanumeric information) for cockpit display 104. In particular, in addition to displaying maps and other related information, the display includes generated indications of any relevant off-scale traffic identified as of interest (e.g., actually and potentially conflicting with ownship), that may be associated with an impending flight phase operation, e.g., runway crossing, runway entry, approach, takeoff, or landing. So, the system 100 may include a map database 106 with displayable maps including airport maps, and may include other pertinent information, e.g., runway and taxiway intersection points, hold lines, deicing areas, gates, ILS protected areas, and NOTAM info. Processor inputs include ownship data and information from a location finder 108, traffic data and information from a traffic system 110 and pilot inputs from a manual or other input device 112. The processor 102 extracts off-scale traffic display information, filters unfiltered traffic data and combines the filtered results with the map of a local airport or airspace from map database 106 for display on cockpit display 104. The system 100 may also include a speaker 114 for providing aural outputs.

In particular, a preferred system 100 combines map data/info from database 106 with ownship data/info from a location finder 108 to map ownship location and immediate surrounding areas, e.g., airport runways, taxiways, ramps, buildings, concourses, and gates, or airspace navigation aids (navaids), terrain and airways. In addition to displaying the map on cockpit display 104, the system 100 indicates traffic data/info from traffic system 110 as manually or otherwise selected by pilot inputs 112, e.g., on cockpit display 104 and, optionally, aurally on speaker 114. Ownship and traffic may be on a taxiway or on a runway, landing, taking off or on approach. So in addition to on-scale traffic, a preferred system selectively provides off-scale traffic indications, automatically and continuously, filtered to provide traffic awareness and facilitate evaluating traffic information.

The processor 102 may be any suitable processor, such as described in, for example, U.S. Pat. No. 7,222,017, entitled "METHOD AND SYSTEM FOR ENTERING AND DISPLAYING GROUND TAXI INSTRUCTIONS," to Samuel T. Clark et al., filed Jun. 17, 2004, issued May 22, 2007, assigned to the assignee of the present application, and is hereby incorporated herein by reference. The display 104 may be any suitable display such as, for example, a cathode ray tube (CRT) display, a liquid crystal display (LCD), a head up display (HUD), a plasma display, a rear projection display, or a head worn imaging display. Preferably, displayable airport maps in the map database 106 include details such as, for example, runways, taxiways, terminal and other permanent structures, parking locations, and run-up locations. A suitable example of one such database may be found in Jeppesen's Electronic Flight Bag with Airport Map application.

Preferably, the off-scale traffic is displayed on cockpit display 104, during taxiing, take off, approach and landing and in other flight phases, to enhance safety and facilitate efficient ownship operation. Also, to help avoid possible information overload, a preferred system is very selective and allows filtering of most off-scale traffic as unimportant to ownship, e.g., traffic on taxiways may be ignored. Further, in determining what off-scale traffic to indicate, a preferred system defines a space or a "runway box" around each runway, and only traffic within a runway box, and only runways relevant to current ownship position and path may be considered. In other than the airport environment a volume of space may be defined about ownship and utilized to trigger the display of off-scale traffic indication. Thus, only a very small percentage of off-scale traffic triggers an on-screen indication or an aural.

A runway box may be defined, for example, as contained within two hundred feet (200') to either side of the runway centerline, three nautical miles (3.0 nm) beyond the runway ends and below 1000' above ground level (agl). Optionally, a runway box may include volume above intersecting runways and taxiways. Ownship runway is the runway currently occupied by ownship with ownship heading aligned to within a minimum angle (e.g., 30°) of the runway heading. Similarly, ownship takeoff runway is the runway currently occupied by ownship with ownship thrust at a selected minimum, e.g., with left or right (L or R) ownship thrust >80%. Ownship landing runway is the runway specified in the flight management computer, the taxi route, or any runway box ownship is within in-air with ownship heading within 30 degrees of that runway heading.

Preferably, only traffic entering or in a runway box may trigger a preferred system to provide an off-scale traffic indication. Moreover, the frequency with which these off-scale traffic indications occur may be further filtered/reduced by limiting triggers to only runway traffic on a track or heading that intersects or potentially intersects with ownship track or heading. More specifically, off-scale traffic triggers may occur upon the intersection of ownship and off-scale traffic tracks or headings at or in the vicinity of a taxiway-runway intersection or a runway-runway intersection. For taxiing, triggers may occur based on just the next intersecting runway ahead of ownship. However, for takeoff and landing, triggers may occur based on any intersecting runway ahead of ownship. Also, it should be noted that there may be special cases that must also initiate triggers, such as where ownship track or heading intersects off-scale traffic itself or an off-scale traffic track or heading intersects ownship itself at or in the vicinity of a taxiway-runway intersection, a runway-runway intersection, or in the same runway box.

Ownship location finder 108 may include any suitable on-board system. Suitable on-board systems include in part, for example, a Global Positioning System (GPS), an inertial navigation system (INS), a terrestrial based navigation system (such as VHF Omni-directional radio Range (VOR) or Tactical Air Navigation (TACAN)), and/or a manual or other input providing starting or current position. The specific ownship information provided may include, for example, position, heading, altitude, speed, vertical speed, thrust, in-air or on-ground status, runway (R/W) exit, taxi route, takeoff runway, and landing runway. The traffic system 110 may be, for example, an Automatic Dependent Surveillance-Broadcast (ADS-B) system and/or any other suitable system (e.g., Traffic Information Service Broadcast (TIS-B) or Controller Pilot Data Link Communications (CPDLC)) that identifies and locates off-scale aircraft and other traffic, and may provide additional operational information, e.g., active runways, Land and Hold Short Operations (LAHSO) or Airport Movement-Area Safety System (AMASS) info/alerts.

Preferably, the traffic system 110 selects gathers and provides traffic data and information with respect to ownship taxi path and, especially current ownship location, e.g., within a few nautical miles of the present airport. Specifically, the traffic data and information provided may include, for example, traffic type, traffic identification (ID), position, heading, speed, thrust, altitude, vertical speed, in-air or on-ground status, vehicle center of gravity (CG), pilot eye reference point (ERP), taxi route, takeoff runway, and landing runway. The input device 112 may provide hard and soft key entries (e.g., for range selection, map mode, traffic filtering, etc) as well as involve manipulation of a suitable cursor control device. Thus, the input device 112 may be any suitable device such as a keyboard, a mouse, a touchpad, a joystick, or any other device (not shown) suitable for providing an electronic computer input or controlling a cursor. Optionally, the cockpit display 104 may be touch sensitive.

Figure 2:
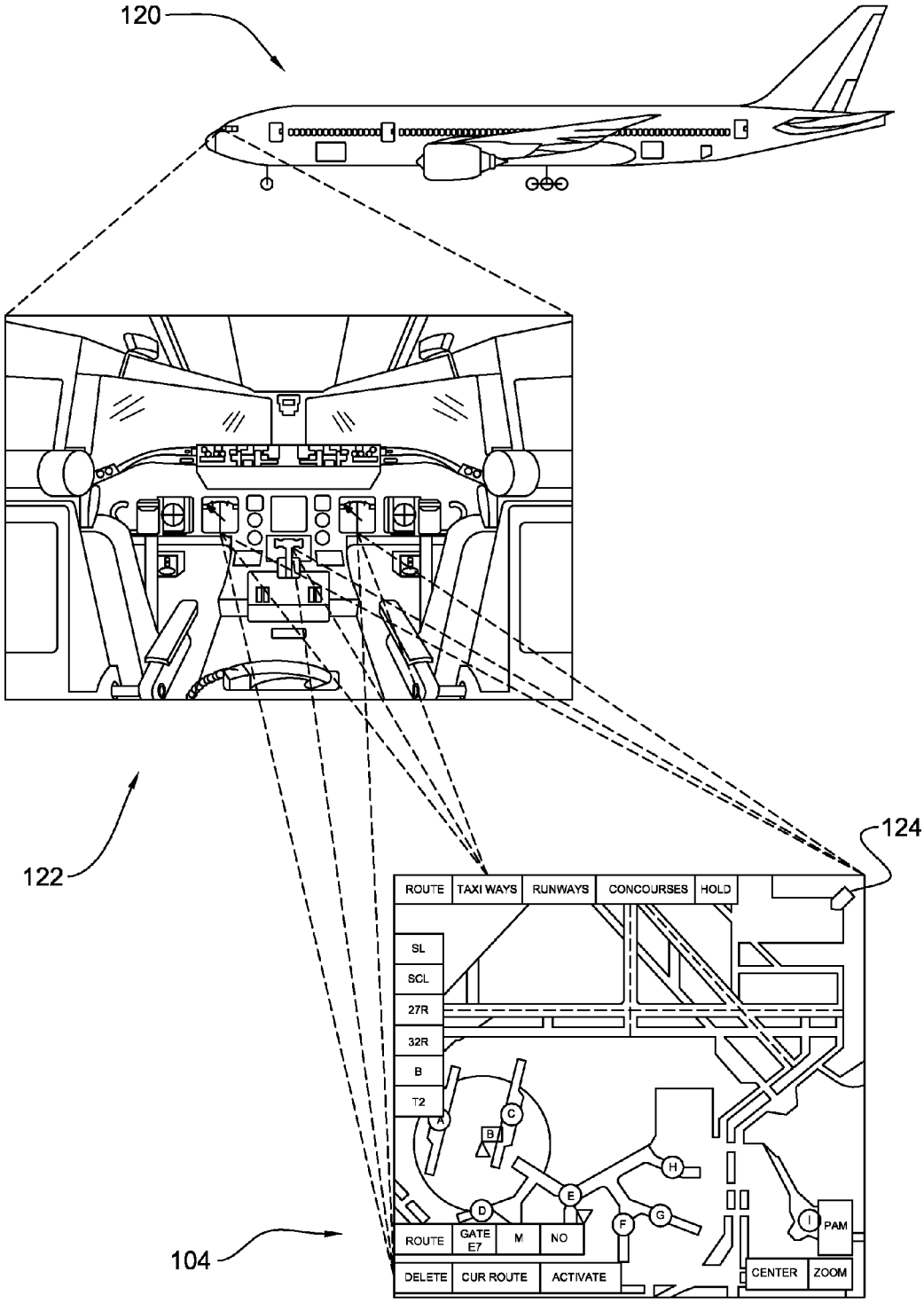
FIG. 2 shows an example of possible display positions of an airport moving map or traffic display on an aircraft.

FIG. 2 shows an example of possible display 104 positions on an aircraft 120, i.e., in the cockpit 122, and providing off-scale indications, e.g., 124. Although this drawing shows that the display 104 may be mounted in any one or more of multiple locations on an instrument panel of the cockpit 122, the display 104 may be mounted in any cockpit location that is convenient for the pilots and where space is available. Further, the display 104 may be incorporated into existing aircraft systems and displays; it may also include a stand-alone system.

The system 100 may be configured to provide off-scale indication in full time mode, in automatically activated mode in response to certain criteria, or by pilot selection. Once off-scale indication mode is enabled, the system automatically and continuously determines and displays off-scale traffic 124 of interest to ownship operation. The crew may selectively or completely deactivate off-scale indication, or in automatic mode the occurrence of logical or other operating conditions may permanently, temporarily, or selectively deactivate off-scale indication. These other logical or operating conditions may include, for example, a time delay, on engine shutdown, at a specific ownship location, speed, configuration, and/or altitude. These and other various system states and modes may be indicated or annunciated to the crew and other traffic.

Figure 3:
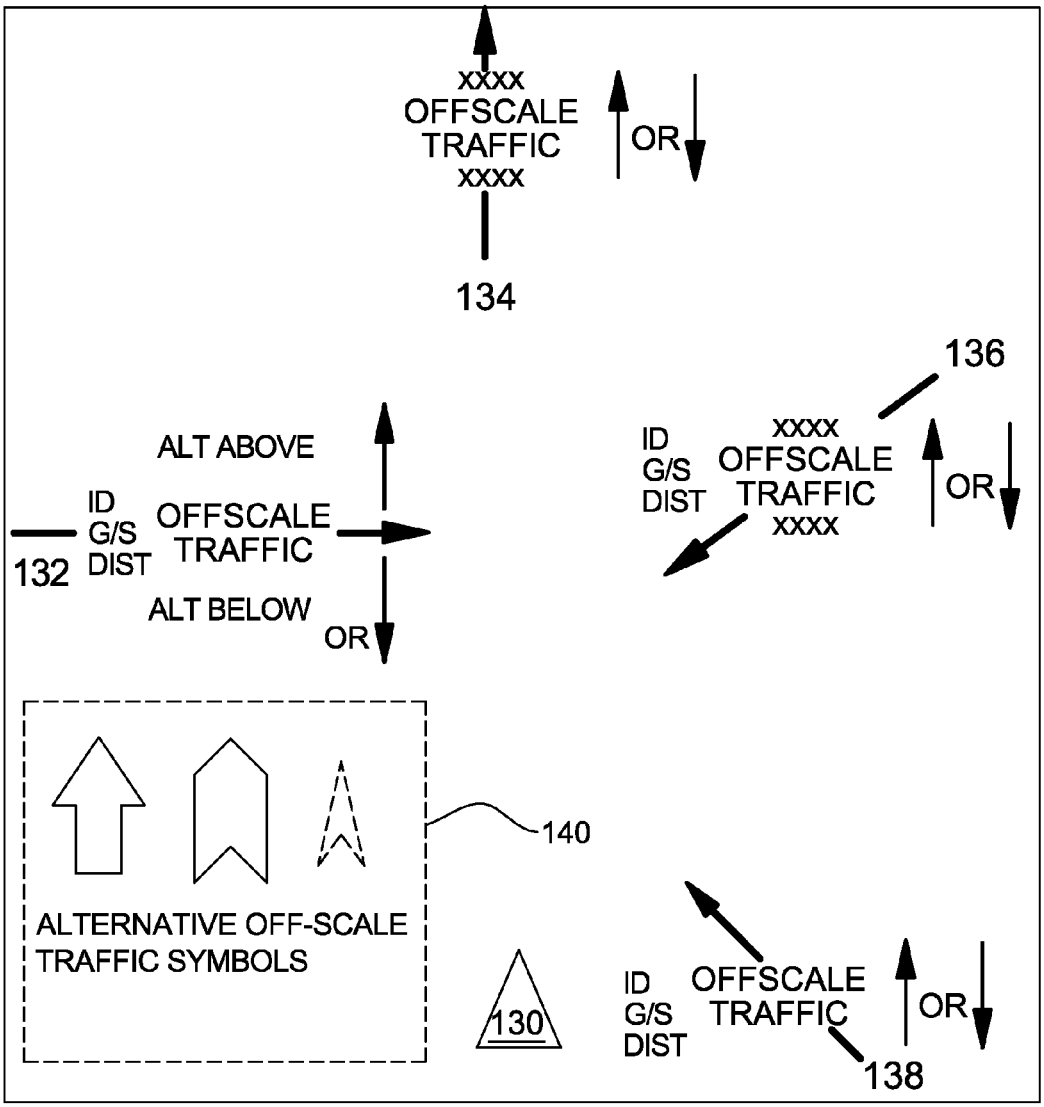
FIG. 3 shows an example of graphical and alphanumeric indications and traffic information provided to inform the crew of off-scale traffic.

FIG. 3 shows an example of various different graphical and alphanumeric indications that may be provided and overlain on the moving map to indicate off-scale traffic to the crew. In this example, ownship is represented by triangle 130 and off-scale traffic is represented by arrows 132, 134, 136 and 138, that indicate the bearing/track or heading of the respective off-scale traffic. In addition, each off-scale traffic indication 132, 134, 136 and 138 may include for the corresponding vehicle/aircraft: a vertical direction indication, altitude (xxxx above/below ownship), an identifier (ID), ground speed (GS in knots (kts)) and distance (Dist) and/or time in seconds (s) from intersection point or ownship. Further, traffic vertical direction may indicate the aircraft is climbing or descending and may be displayed when vertical speed exceeds 200-500 feet per minute (fpm). Altitude may be relative or absolute.

The traffic identifier may indicate carrier and flight number, e.g., UAL 007. Distance from ownship or intersection, typically, is given in nautical miles, e.g., to the nearest 0.1 nm. Time from ownship or intersection, typically, is given in seconds or minutes and seconds. This example also includes three alternate display symbols in box 140 that may be selected to indicate off-scale traffic instead of, or with arrows 132, 134, 136 and 138. Also, the off-scale traffic text and track arrow may have variable/selectable color, e.g., white, blue, green, brown, amber, red, and size. For example, color or size may change as a function of in air or on ground state, speed, runway (r/w) status, alert level, or conflict potential. The indicator size and/or shape may change to reflect acceleration and/or distance or time (e.g., longer during acceleration), or a separate and distinct traffic acceleration vector may be displayed. Also, off-scale traffic information may be completely or selectively deselectable automatically or manually, e.g., with a switch. Moreover, an off-scale traffic indication may be annunciated by an aural (voice or tone) indicator.

Figure 4A:
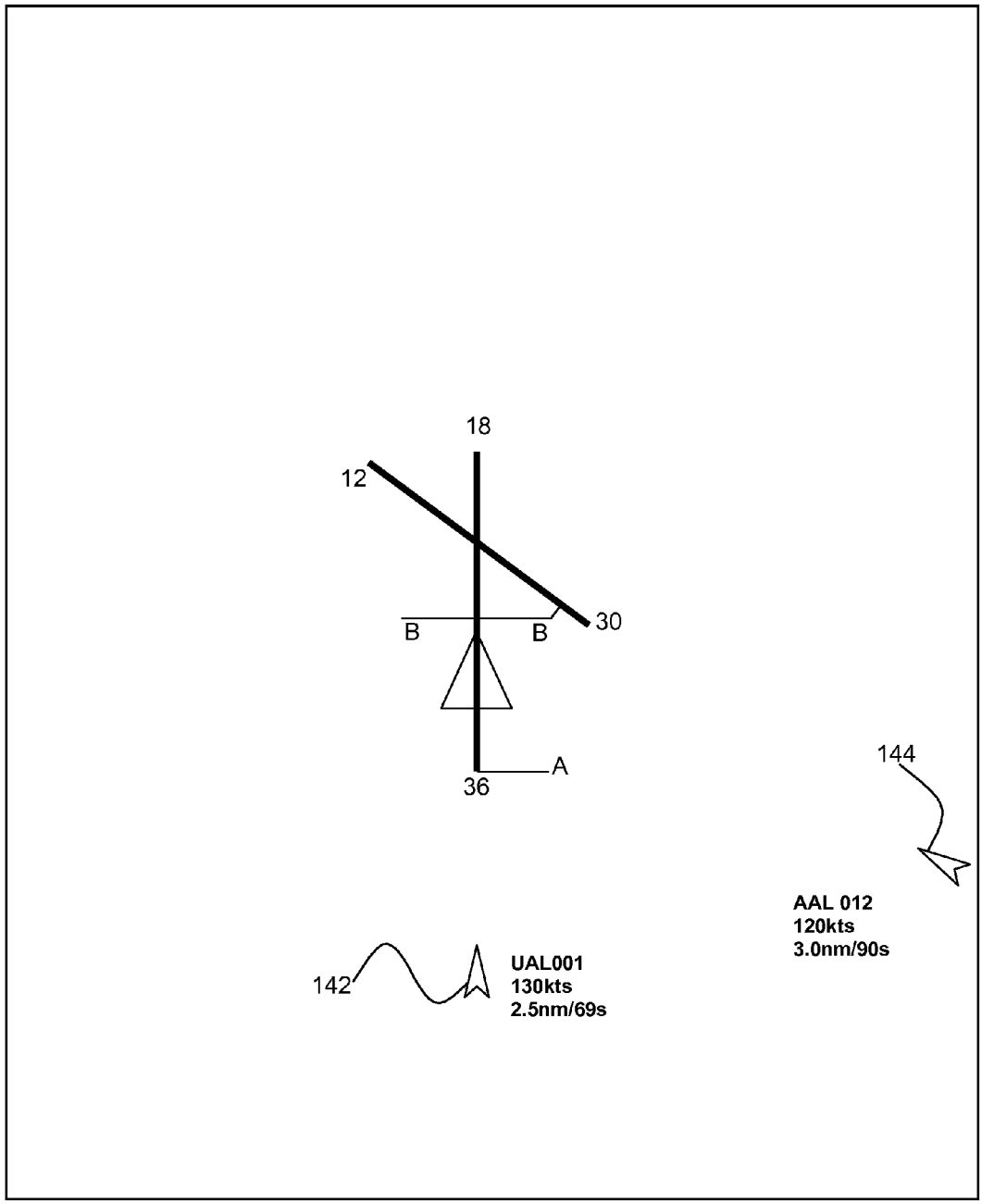
FIGS. 4A-F show display examples of on-scale and off-scale traffic with ownship map display and off-scale traffic at various ranges.

FIGS. 4A-E show display examples (not to scale) of on-scale traffic and then corresponding off-scale traffic indications as the traffic approach, land, rollout, and reverse direction. Runways are identified with typical takeoff/landing heading indications, e.g., 18-36 and 12-30. Taxiways are designated with letter designations, e.g., B. So, FIG. 4A shows a display screen (e.g., 5.0 nm display range) with ownship 130 on runway 36, on-scale traffic 142 (UAL flight 001 traveling at 130 kts, 2.5 nm behind, and 144 (AAL flight 012 traveling at 120 kts, 3.0 nm away) shown on approach to runways 36 and 30, respectively.

Figure 4B:
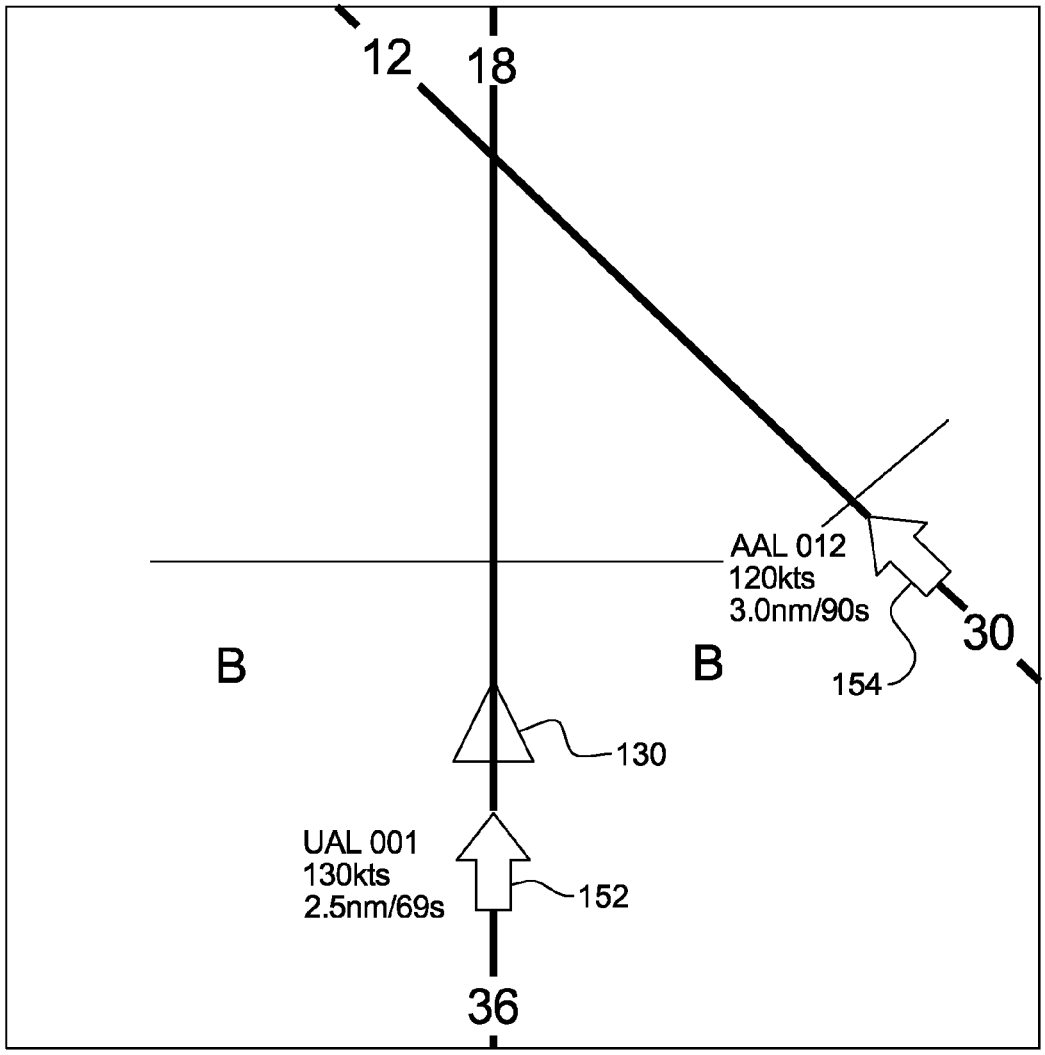

FIG. 4B shows a display screen showing the situation of FIG. 4A at a lower, 1.0 nm display range with ownship 130 on runway 36 and off-scale traffic 152, 154 (aft and right of ownship 130) on approach to runways 36 and 30. Runways 36 and 30 are both shown on scale. Off-scale traffic indications 152, 154 indicate traffic heading/track and are aligned with a runway when the runway is on-scale. Since, both 152, 154 are in the air and on approach, in this example, the indications 152, 154 may be shaded or colored, e.g., green, to indicate that the aircraft is in-air. Also, separate traffic information is included that provides traffic identification, groundspeed, and traffic distance and/or time from intersection or ownship.

For off-scale runways, off-scale traffic indications may be located in display corners with the particular corner indicating the relative location of the off-scale traffic. So, the indication for off-scale traffic on an off-scale runway is located in a corner of the display. The left corner when off-scale traffic is left of ownship; the right corner when off-scale traffic is right of ownship; a forward corner when off-scale traffic is ahead of ownship; and an aft corner when off-scale traffic is behind ownship. As indicated hereinabove, these off-scale traffic indications rotate to correspond to traffic heading or track, and translate to correspond to traffic motion within the runway box. Alternatively, off-scale traffic indications may translate freely and be shown where an imaginary line drawn between ownship or the display center and the off-scale traffic intersects the display boundary, e.g., tracking relative bearing and not necessarily limited to runway and runway box.

Figure 4C:
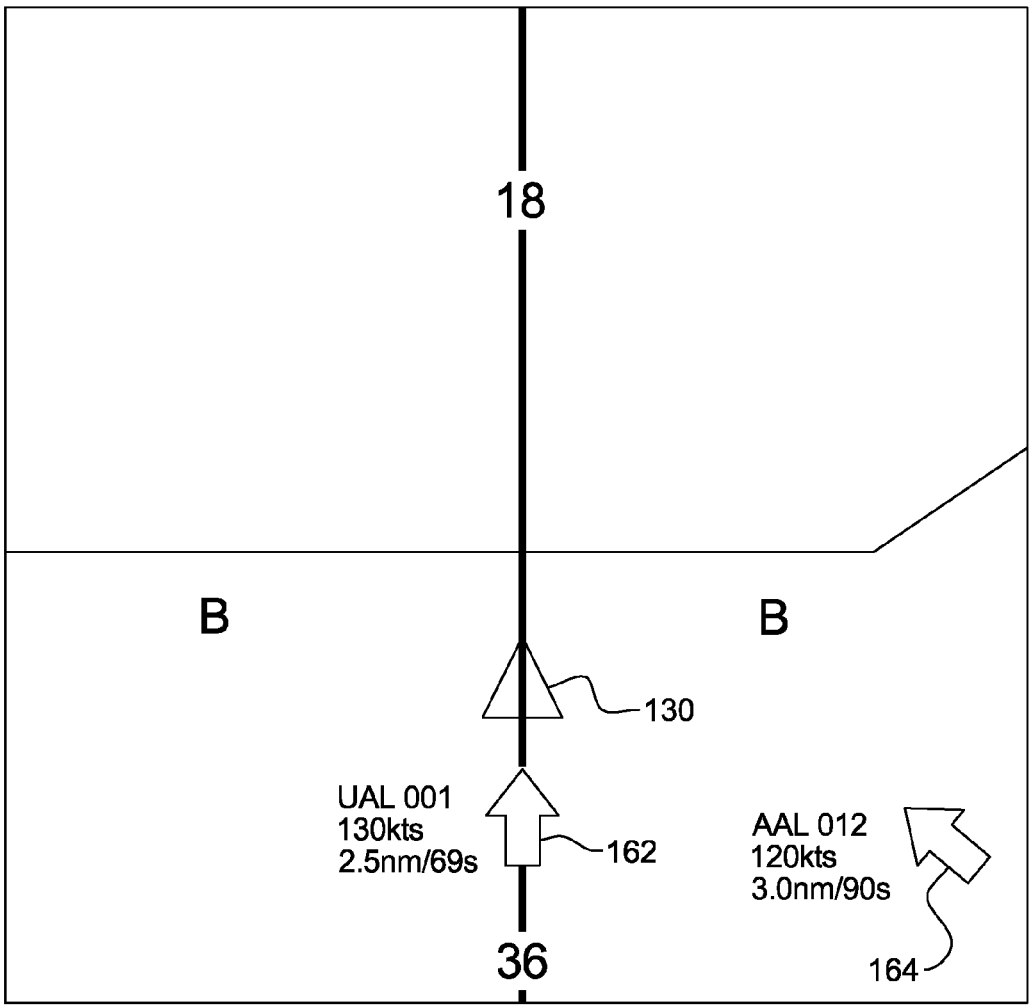

FIG. 4C is an example of a display screen showing the situation of FIGS. 4A and B at an even lower range (approximately 0.5 nm) with ownship 130 on runway 36, runway 36 on-scale, runway 30 off-scale, and in air off-scale traffic indication 162 shown on/aligned with runway 36 and in-air off-scale traffic indication 164 associated with off-scale runway 30 shown in the lower right display corner. Off-scale traffic indications for traffic associated with on off-scale runways are located in display corners substantially as described hereinabove. Similarly off-scale traffic indication 164 indicates traffic heading/track, but is not aligned with the off-scale runway 30. Additionally, off-scale traffic indications 162, 164 may include an indication of air/ground state with, for example, shape, shading or, color, e.g., yellow or brown to indicate on-ground traffic. Again, off-scale traffic indications 162, 164 include traffic identification, groundspeed, and traffic distance and/or time from intersection or ownship.

Figure 4D:
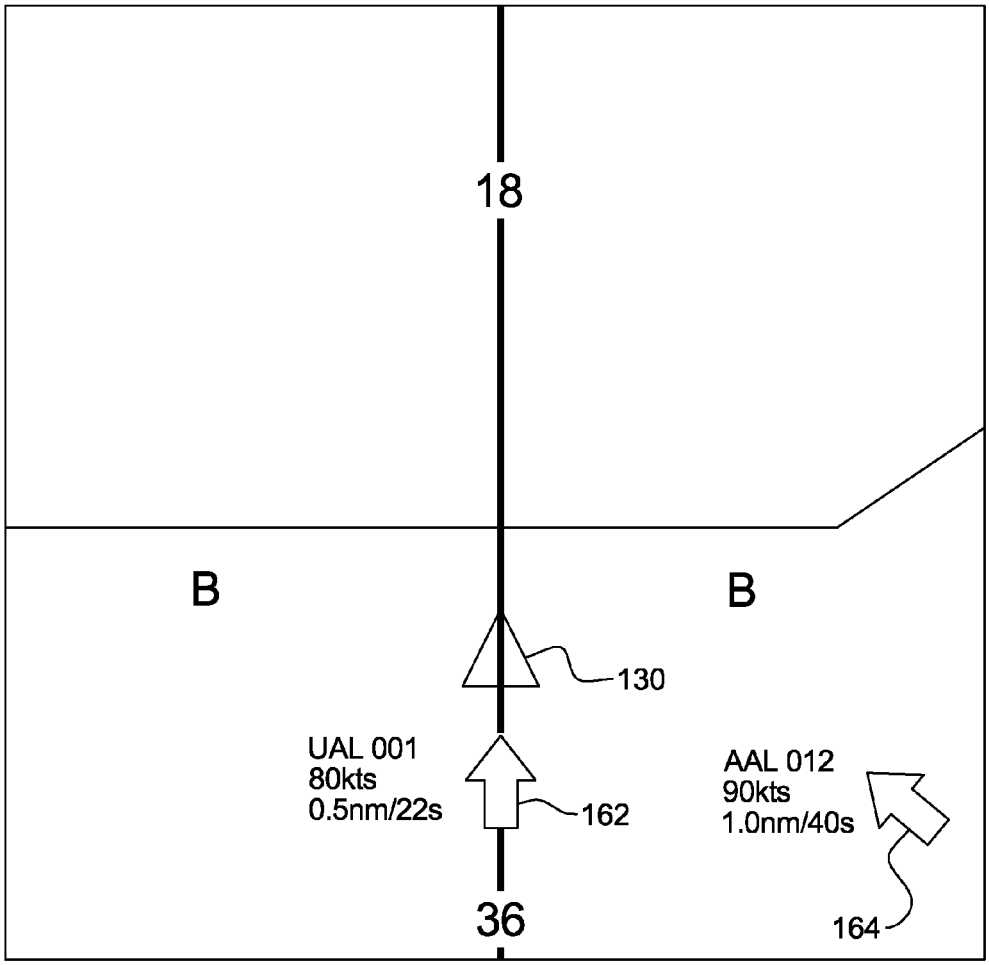

FIG. 4D shows a display screen example at approximately 0.5 nm range with ownship 130 on runway 36, e.g., after both 162 and 164 have landed. The on-ground off-scale traffic indication 162 is aligned with on-scale runway 36, and the on-ground off-scale traffic indication 164 for off-scale traffic on off-scale runway 30 is in the lower right display corner, not aligned with runway 30. In addition to indicating traffic heading/track, the indications 162, 164 may be shaded or colored to visually indicate air/ground state, e.g., brown to indicate on-ground traffic. Alternately, the shape of the off-scale traffic indications 162, 164 may visually indicate air/ground state (e.g., larger/smaller, lighter/bolder line, thicker/thinner line, or with different shapes). Also as shown above, separate traffic information may be included to provide traffic identification, groundspeed, and traffic distance and/or time from intersection or ownship. Off-scale indications 162, 164 may rotate relative to ownship with traffic heading or track, and translate slightly corresponding to traffic motion within the runway box. Alternatively, the off-scale indications 162, 164 may be fixed to respective runway centerlines and not translate.

Figure 4E:
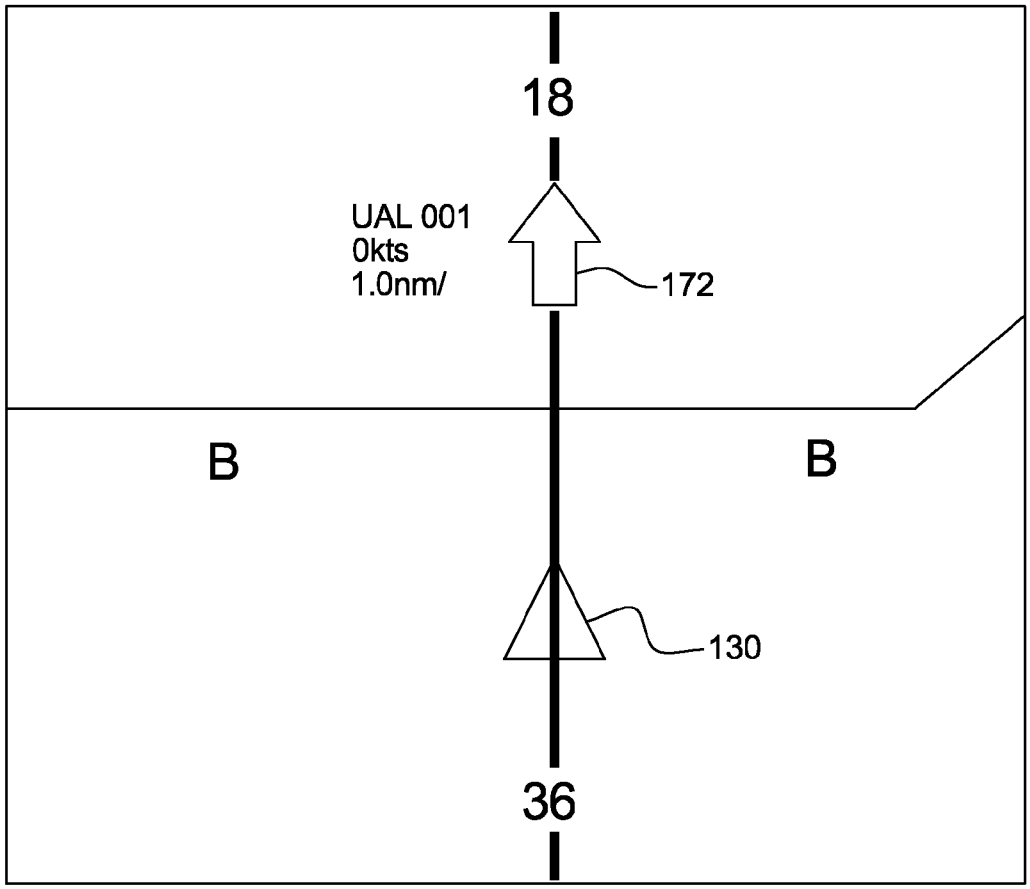

FIG. 4E shows a display screen example with ownship 130 on runway 36 with on-ground off-scale traffic ahead, e.g., after landing 172. Again in this example, off-scale traffic indications for on-scale runways are aligned with runway and indicate traffic heading/track. Off-scale traffic indications for off-scale runways are placed in the corner representing the traffic position relative to ownship (e.g., left/right and ahead/behind). So, off-scale runway traffic indication 172 is on runway 36. Off-scale traffic on runway 30 (ahead and left of ownship 130) with runway 12-30 also off-scale is not shown because it cannot conflict with ownship and in this example is not otherwise relevant or of interest. Off-scale traffic indication 172 may be colored to indicate an air/ground state, e.g., brown for on-ground or green for in-air. Separate traffic information for off-scale traffic provides traffic identification, groundspeed, and traffic distance and/or time from intersection or ownship with off-scale traffic indicators located in corners, e.g., 164 in FIGS. 4C and D.

Figure 4F:
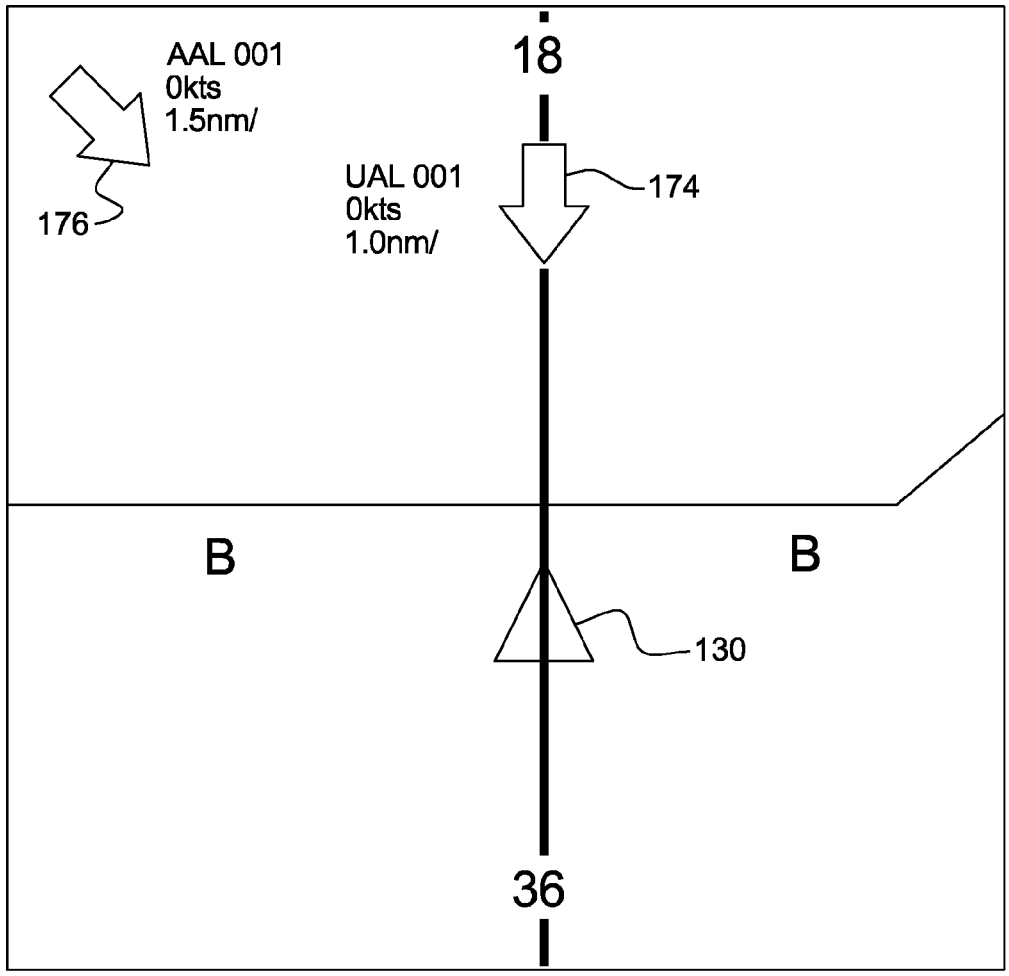

FIG. 4F shows a display screen example with ownship 130 on runway 36 with on-ground off-scale traffic ahead 174, 176. Again in this example, off-scale traffic indications 174 for on-scale runways (18-36 in this example) are aligned with runway 18 and indicate traffic heading/track, while off-scale traffic indications 176 for off-scale runways (12-30 in this example) are in a corner representing the respective traffic position relative to ownship (e.g., left/right and ahead/behind). So in this example, off-scale runway traffic 174 is ahead on runway 36 heading 180 towards ownship. Off-scale traffic 176 heading 120 is ahead and left of ownship 130 on off-scale runway 30. Also, off-scale traffic indications 174, 176 may be colored to indicate an air/ground state, e.g., brown for on-ground or green for in-air. Separate traffic information for each off-scale traffic located with off-scale traffic indicators 174, 176 provides traffic identification, groundspeed, and traffic distance and/or time from intersection or ownship.

Off-scale traffic indications are triggered for display as determined hereinabove, both based on ownship location, heading status and off-scale traffic location, heading and status. While ownship is taxiing to cross, approaching, or on, a runway, the system (FIG. 1) automatically assesses all off-scale traffic, filters and selects specific off-scale traffic that may intersect with ownship. Then, the system provides an indication for said selected off-scale traffic that is an actual or potential conflict with ownship. During ownship taxi, takeoff, or approach/landing, the indication may include relevant parallel or intersecting taxiway and intersecting runway off-scale traffic. Thus, a preferred system 100 displays an off-scale traffic indication until the off-scale traffic enters the currently selected display range (i.e., is visible on the display) or is no longer of interest or relevant to ownship operation, e.g., passes the intersection point with ownship, diverges from ownship position/path, becomes airborne, stops, changes direction, or otherwise is no longer an actual or potential traffic conflict.

Also, optionally, an aural (voice or tone) may accompany the off-scale traffic indication. The aural may be any tone sequence or signal that conveys sufficient information about the off-scale traffic. For example, the aural may be a simple single sound, or a complex stereoscopic sound that changes, right-ear, left-ear, pause (i.e., no tone), slewing the tone from right to left or vice versa to indicate off-scale traffic motion. Similarly, a tone from both the right and left with changing volume may indicate off-scale traffic ahead/behind. Also auditory indications may be rendered in three dimensions or externalized to indicate actual traffic location.

Figure 5A:
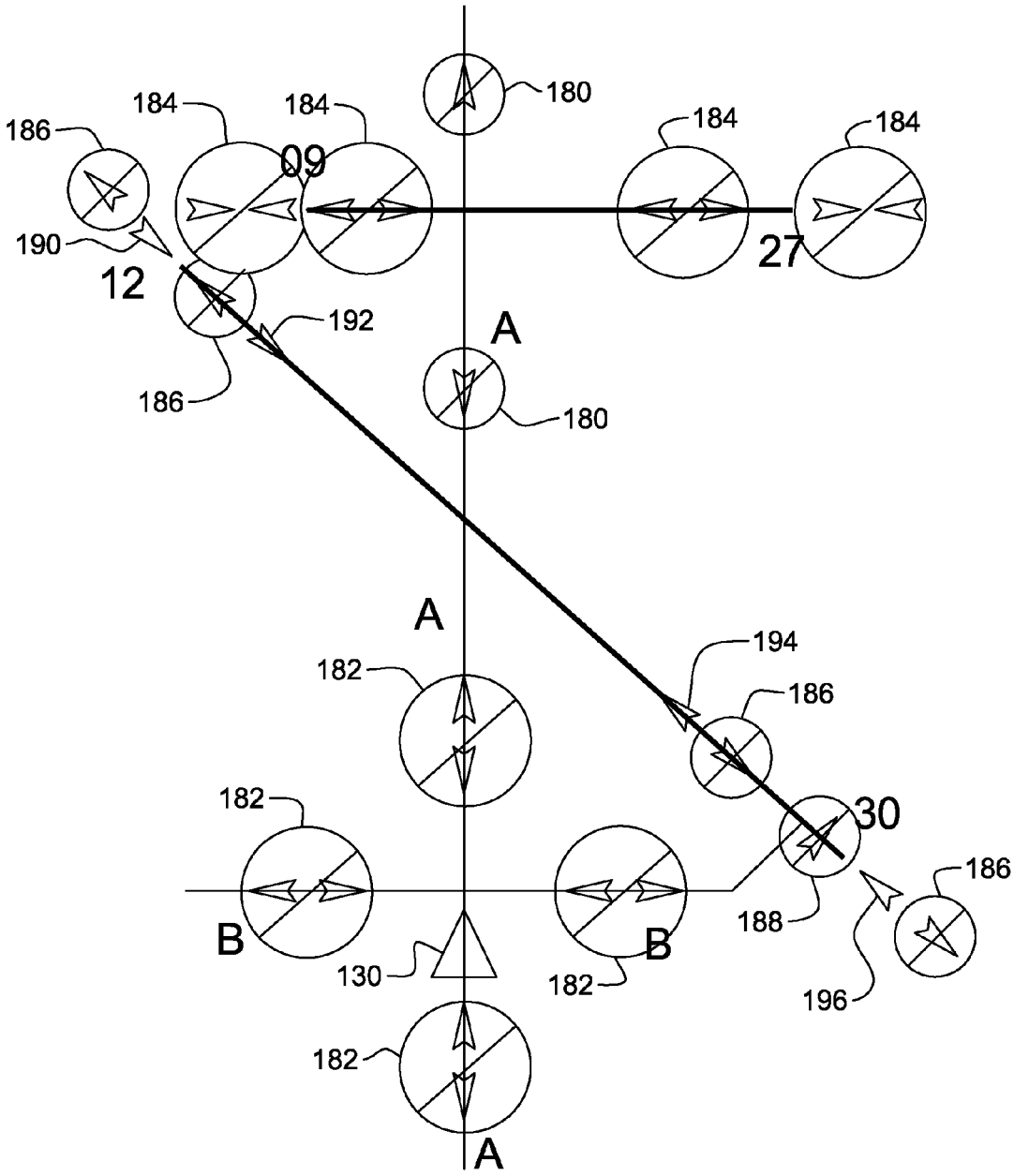
FIGS. 5A-B show an example of a section of an airport with ownship taxiing on taxiway A to a takeoff runway 12-30 or 09-27 and illustrating on-scale traffic display filtering and off-scale airport traffic which would trigger indications.
Figure 5B:
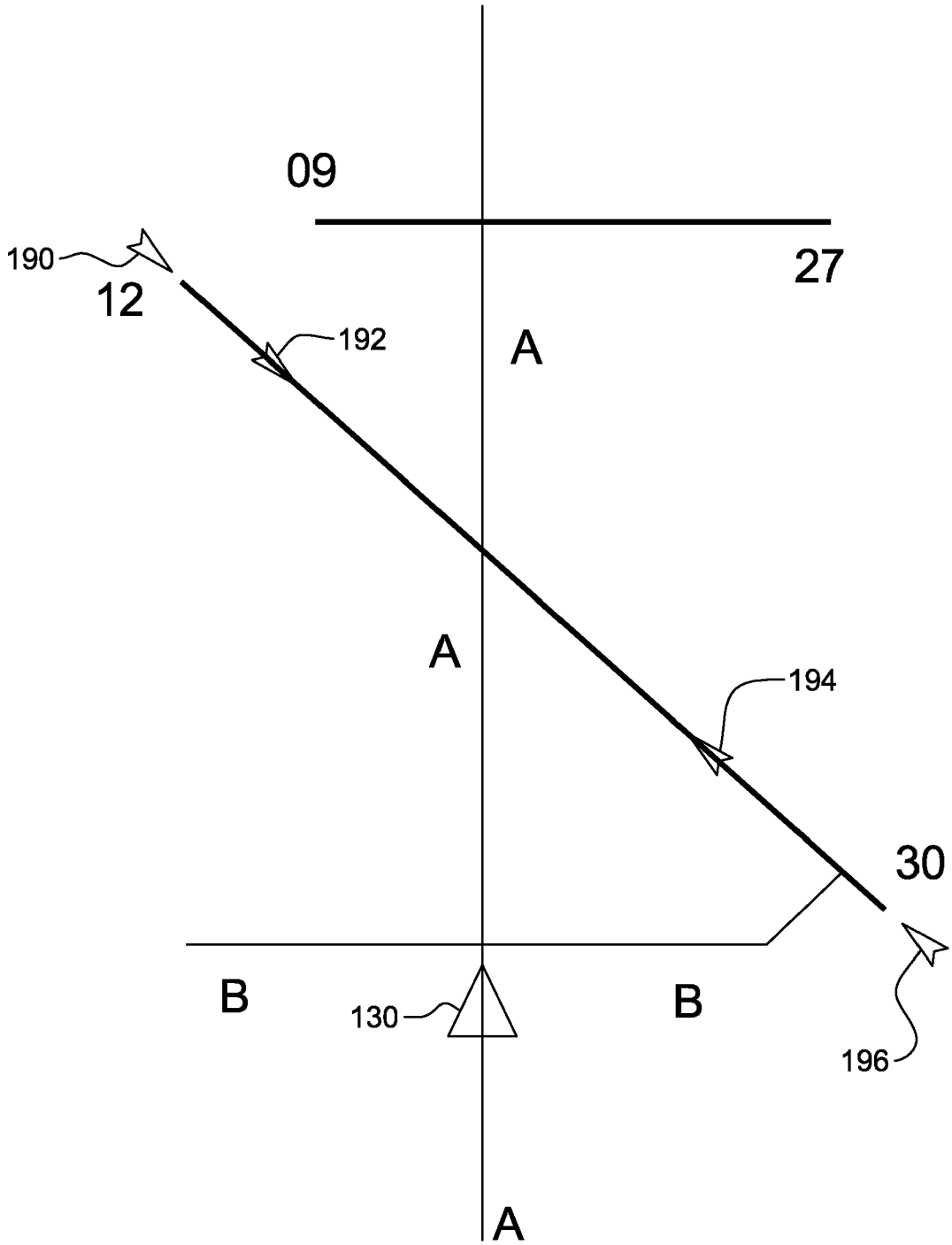

FIGS. 5A-B show an example of an airport section (not to scale) contrasting filtered with unfiltered traffic with ownship 130 taxiing on taxiway A, crossing runway 12-30 and 09-27. More particularly, FIG. 5A shows an unfiltered representative example of traffic 180, 182, 184, 186, 188, 190, 192, 194 and 196 scattered at various random, representative locations, conducting various different operations and in different states. It should be noted that all unfiltered traffic 180-196 are intended to be for example and illustration only. Thus, although the present example shows traffic simultaneously headed in opposite directions on airport runways and/or taxiways, it is unlikely that actual traffic ever would be configured as shown in this and other examples provided hereinbelow. FIG. 5B shows a representative example of filtered traffic 190-196. In either filtered or unfiltered example (analogous to band pass filtering), the filtered traffic is exemplary of traffic that would trigger an off-scale traffic indication display according to an advantageous embodiment of the present invention.

For the example where the display range is selected such that traffic at all locations in FIG. 5A is off-scale, FIG. 5A contrasts unfiltered off-scale traffic locations 180-196 with filtered off-scale traffic locations 190-196. This filtered off-scale traffic 190-196 may be of interest (e.g., to ownship flight crew) and would, therefore, be identified and displayed by a preferred system, e.g., passed to the display. The much larger volume of traffic 180-188 may not be of interest and so, would be ignored, e.g., blocked from the display. Preferably, the filter is determined by current ownship location, orientation, and status and traffic location, orientation, and status. A preferred system does not trigger off-scale indication for this larger volume of traffic 180-188 which may be removed or blocked from the display by filtering. In this example, ignored off-scale traffic is shown overlain with the universal symbol for "no," i.e., a circle with a diagonal line through it. As used hereinbelow, filtered traffic includes traffic identified for on-scale display and of interest traffic identified for off-scale indication by a preferred system; unfiltered traffic is all traffic and includes both of interest traffic and ignored traffic, i.e., on-scale traffic that is not displayed and off-scale traffic that is not indicated by a preferred system.

So in this example, a preferred system (e.g., 100 in FIG. 1) ignores taxiway traffic 180, 182, regardless of heading, and does not generate triggers to display off-scale indicators. Further, at least until ownship 130 passes runway 12-30, the preferred system ignores traffic 184 on runway 09-27 and any traffic that might be on any other runway than runway 12-30. On runway 12-30, the preferred system ignores traffic 186 because it is headed away from the intersection with taxiway A and so, cannot possibly conflict with ownship crossing runway 12-30. Also, the preferred system ignores traffic 188 because it is headed across the runway (or has a heading >30 degrees (30°) off the runway heading) and thus will not cross the taxiway A intersection or intersect ownship 130.

As shown in the example of FIG. 5B, since the taxiway A first intersects with runway 12-30, some off-scale traffic 190, 192, 194 and 196 may be on a conflicting path and may, therefore, be of interest traffic and so, displayed. Thus, a preferred system considers only aircraft 190, 192 and 194, 196, respectively, taxiing, taking off, or landing, and other aircraft 186 that are defined or designated of interest e.g., coupled. Moreover, this group of aircraft 190, 192, 194 and 196 may be filtered differently for purposes of determining on-scale display or off-scale triggers in this application, e.g., by removing from consideration aircraft more than a selected altitude agl, e.g., 750' agl. Also, the traffic may be further filtered according to speed ignoring, for example, stopped traffic (0 kts) or below a minimum threshold speed, e.g., 5 kts. Also, the traffic may be further filtered according to a selected distance or time from intersection or ownship. On-scale traffic display filtering and off-scale traffic indication may be filtered by the same, or similar, or different logic. On-scale traffic display filtering may be done to reduce crew monitoring, detection, and interpretation workload; while off-scale traffic indications are added to increase crew awareness of actual or potential traffic conflicts or other traffic of interest. In particular during ownship taxi, only on ground (on-ground) or runway traffic, at or below 750' agl (≦750' agl), may be considered "relevant-traffic" that may trigger an off-scale display indication. Again, as previously noted for intersecting runways during taxi, only relevant-traffic on the next intersecting runway at the intersection ahead of ownship is typically of interest.

Preferably, during ownship 130 taxi, the system generates off-scale indication display triggers for intersecting relevant-traffic in the next runway box intersecting ownship path, and, when ownship is crossing or taxiing on a runway (i.e., aligned within 30° of the runway heading), in the same runway box as ownship. Moreover, relevant-traffic triggers an off-scale indication primarily for the next intersecting runway box that is in a position to conflict or to potentially conflict with ownship, i.e., intersects ownship track. So, preferably, relevant-traffic may potentially trigger an off-scale indication for an actual or potential conflict at any intersection of runways with one another, of taxiways with one another or of a runway with a taxiway or vice versa. Thus during taxi, for all relevant-traffic, off-scale indication display triggers may be generated by top level trigger logic according to:

{relevant-traffic in the next intersecting runway box in ownship route} OR

{relevant-traffic in the next runway box intersecting current ownship taxiway segment} OR {relevant-traffic in any runway box ownship is also in on-ground} OR {any traffic manually or automatically coupled or otherwise designated by ownship crew, ATC, or predefined logic}.

Figure 6A:
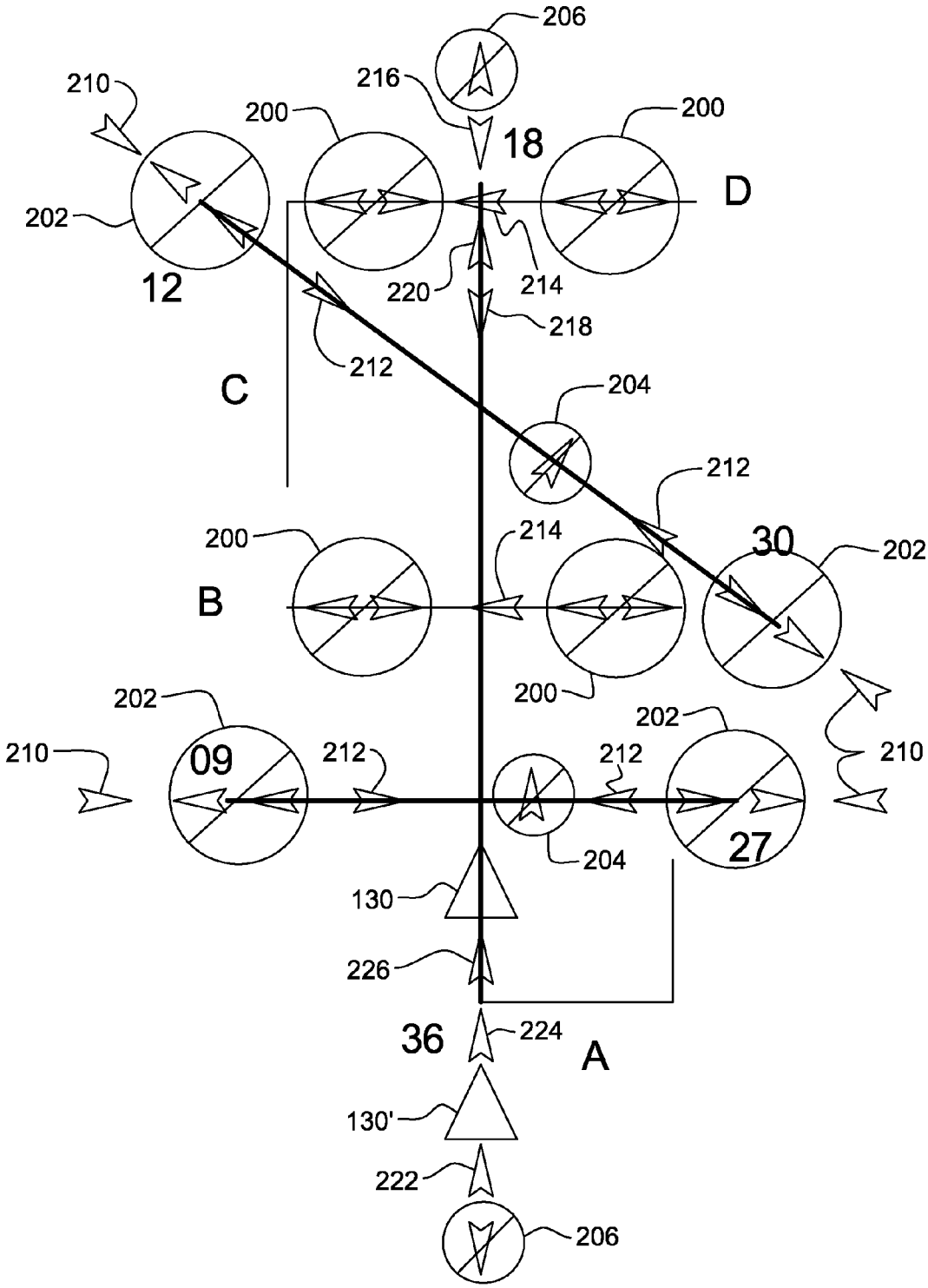
FIGS. 6A-B show an example of on-scale traffic display filtering and off-scale traffic that triggers off-scale traffic indications during ownship takeoff or approach/landing.
Figure 6B:
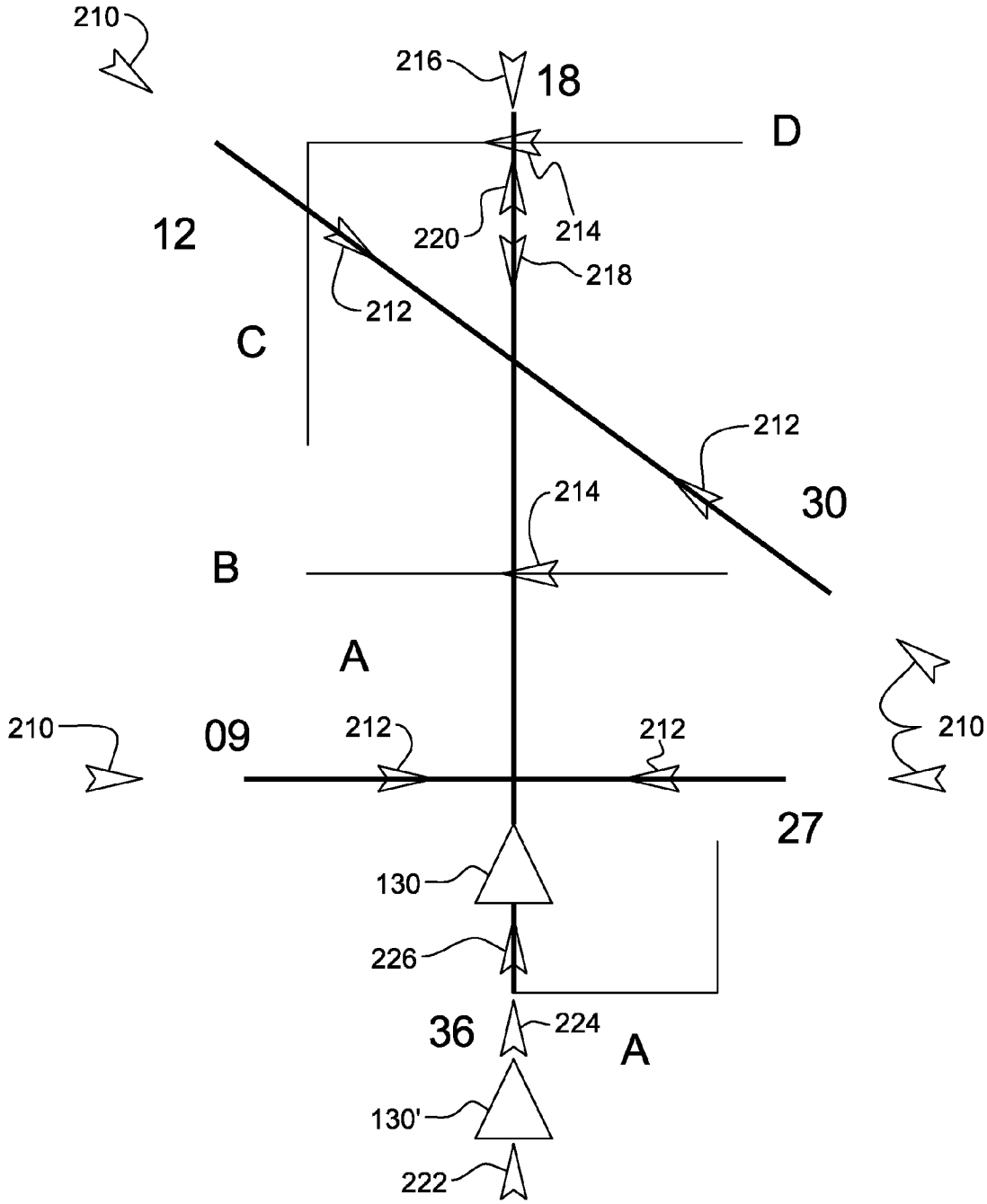

Similarly, as shown in FIGS. 6A-B during ownship takeoff or approach/landing, the system generates off-scale traffic indication triggers for display of relevant-traffic in any intersecting runway, and may display for certain taxiway traffic, that intersects ownship runway box substantially similar to generating triggers for ownship taxiing. However, during ownship takeoff or approach/landing relevant-traffic is moving (groundspeed >5 kts) traffic, and the relevant-traffic track or traffic itself intersects ownship track at a relevant location, e.g., runway-runway intersection, runway-taxiway location, etc. In addition, relevant traffic may not include certain traffic locations (e.g., runway threshold areas) or states (e.g., parking brake set). Once ownship 130 heading is within 30° of a takeoff or landing runway (e.g., from taxiway A), the corresponding runway box is considered the ownship runway box for the purposes of off-scale traffic indication display. Further, once a runway box becomes ownship runway box, that runway box remains ownship runway box until ownship passes the departure end of the runway on takeoff or, leaves the runway box, e.g., turns off onto a taxiway.

So, in the example of FIG. 6A, ownship 130 is positioned for takeoff or 130' on approach for landing on runway 36 with intersecting runways 12-30 and 09-27. Again, representative traffic is shown at several locations with all shown traffic currently off-scale. As long as traffic 200 remains on taxiways B, C and D, it is not indicated. Also, traffic 202 headed away from intersections with runway 18-36 and traffic 204 headed across intersecting runways 12-30 and 09-27 is not relevant and not indicated. Neither is departing traffic 206 indicated because it has passed the departure end of runway 36 or has reached some selected altitude. Outside of the ownship 130 runway box, off-scale traffic 210 on approach to intersecting runway 12-30 and 09-27, and off-scale traffic 212 on intersecting runways 12-30 and 09-27, and also headed to intersect/cross runway 18-36, are indicated. As previously noted, the display of on-scale traffic and off-scale traffic indications may be filtered further for traffic altitude, speed, or other parameters.

So, FIG. 6B shows the same airport segment as shown in FIG. 6A after filtering to eliminate all ignored traffic, such that only relevant-traffic 210, 212, 214, 216, 218, 220, 222, 224 and 226, remains. Again, remaining relevant-traffic 210, 212, 214, 216, 218, 220, 222, 224, 226, is only representative of traffic positioned at locations to trigger off-scale indications according to a preferred embodiment of the present invention. Also again, the logic for on-scale traffic display filtering may vary from that of off-scale traffic indication. Other than intersecting traffic 210, 212 on intersecting runways 12-30 and 09-27, off-scale indication triggering relevant-traffic is primarily in the ownship takeoff runway box or in the ownship landing runway box.

In this example, indicated intersecting traffic 210 is on approach in a runway box to a respective runway 12-30 or 09-27 and headed to intersect with ownship 130 takeoff or landing runway box. Indicated intersecting traffic 212 is taxiing, taking off or has landed and here too, is headed to intersect with ownship runway box. Taxiway traffic 214 is crossing ownship 130 runway in ownship runway box ahead of ownship, and so, triggers off-scale indication. Approaching traffic 216, landing/taxi/standing/takeoff traffic 218 and standing, taxi or takeoff traffic 220 trigger off-scale indications. Likewise, if ownship 130' is approaching or ownship 130 is landing, standing, taxiing or taking off, approaching traffic 216, landing/taxi/standing/takeoff traffic 218 and standing, taxi or takeoff traffic 220 trigger off-scale indications on the display, e.g., 104 in FIG. 1. Further, when ownship 130' is approaching or ownship 130 is landing, standing, taxiing or taking off, fore and aft traffic 222, 224, 226 also trigger off-scale indications if ownship and traffic are converging or traffic is ahead of ownship. In addition, off-scale indications may be provided for any traffic manually or automatically coupled, selected or otherwise designated by ownship crew, ATC, or predefined logic. Again it should be noted that aircraft 210, 212, 214, 216, 218, 220, 222, 224 and 226 are not intended to indicate actual locations of all aircraft during ownship takeoff and approach/landing, but are merely representative of locations, headings and states of traffic that trigger off-scale display indications.

In particular, during takeoff and landing, off-scale traffic indications are triggered/provided while ownship is on the takeoff/landing runway, i.e., between entering the designated departure or takeoff runway and until takeoff is complete, e.g., with ownship 130 in air, at an altitude or speed above some selected altitude or speed, or beyond the runway departure end. To address ownship back taxi, again, ownship is considered only on the route defined takeoff or landing runway when ownship heading is within 30° of the takeoff/landing runway heading (not the reciprocal).

Thus, the takeoff runway may be identified by:

{the departure runway in route} OR

{any runway box occupied by ownship, ownship heading within 30 degrees of that runway heading, and with left or right (L or R) ownship thrust >80%}.

Thus during takeoff, for example, ownship may be designated on the takeoff runway as determined according to top-level logic satisfying:

{Ownship on ground} AND
{in runway box} AND
{aligned within 30 degrees of the runway heading} AND
{{the runway is route takeoff runway} OR
{left engine N1>0.8} OR
{right engine N1>0.8}}.

Optionally, the top level trigger logic may filter out on-scale display and/or off-scale indication of traffic on approach or landing some altitude, distance or time behind ownship and further, the top level logic defining takeoff runway may include (AND):

{takeoff flaps 5 OR 15 OR 20} OR
{ownship groundspeed >50 kts}.

Similarly, during approach/landing the approach/landing runway is:

{the landing runway in route} OR

{any runway box ownship is within in-air with ownship heading within 30° of that runway heading}.

Thus during approach/landing, the approach/landing runway may be determined according to the top level logic:

{ownship in-air} AND
{in runway box} AND
{aligned within 30 degrees of runway heading}

Again, optionally, the system may filter out on-scale display or off-scale indication of traffic on approach or landing some altitude above, or some distance or time ahead or behind ownship. If necessary, the top level on-scale traffic display filter or off-scale traffic indication trigger logic may include inputs for altitude, landing flaps 25 or 30, on glideslope/localizer, or other logic could also be added to determine landing runway and relevant-traffic. Also, as with takeoff runway determination, ownship groundspeed (<50 kts) may be selected as a termination point after landing for terminating the landing runway state.

This top level logic is for identifying takeoff and ownship landing runway only and not applied to ownship taxi runway designation. It should be noted that during takeoff or approach/landing, instead of a 5 kt filter, it may be advantageous to filter out traffic movement on intersecting runways that occurs within 500 to 1500' of the runway threshold. This optional filter allows traffic to taxi into position and hold on intersecting runways without triggering off-scale indication. This distance from the runway threshold may also be used to filter on-scale traffic display or status of intersecting runways during ownship takeoff and approach/landing.

Figure 7A:
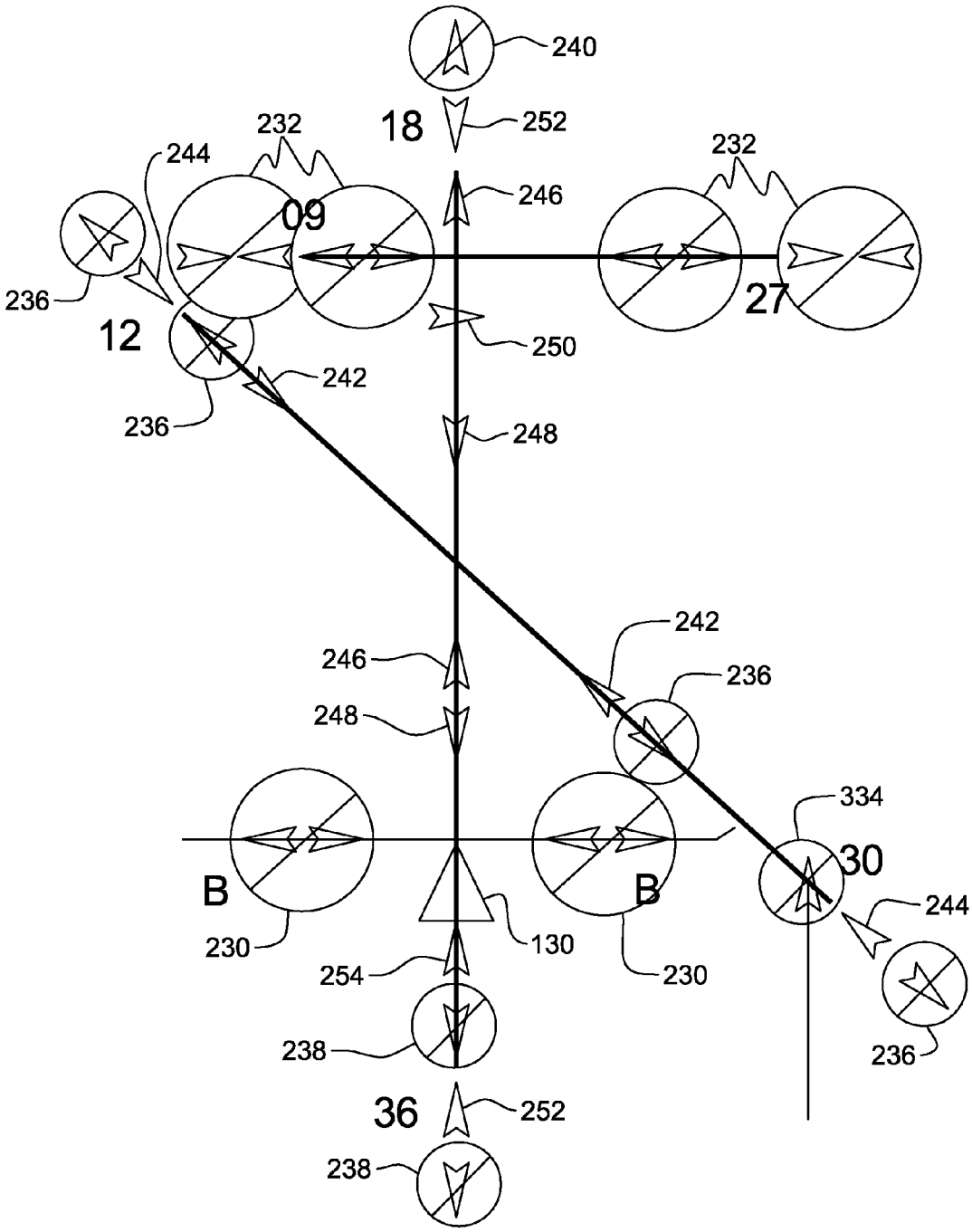
FIGS. 7A-B show an example of on-scale traffic display filtering and off-scale traffic that triggers off-scale indications during taxi, takeoff, or landing with ownship on ownship runway.
Figure 7B:
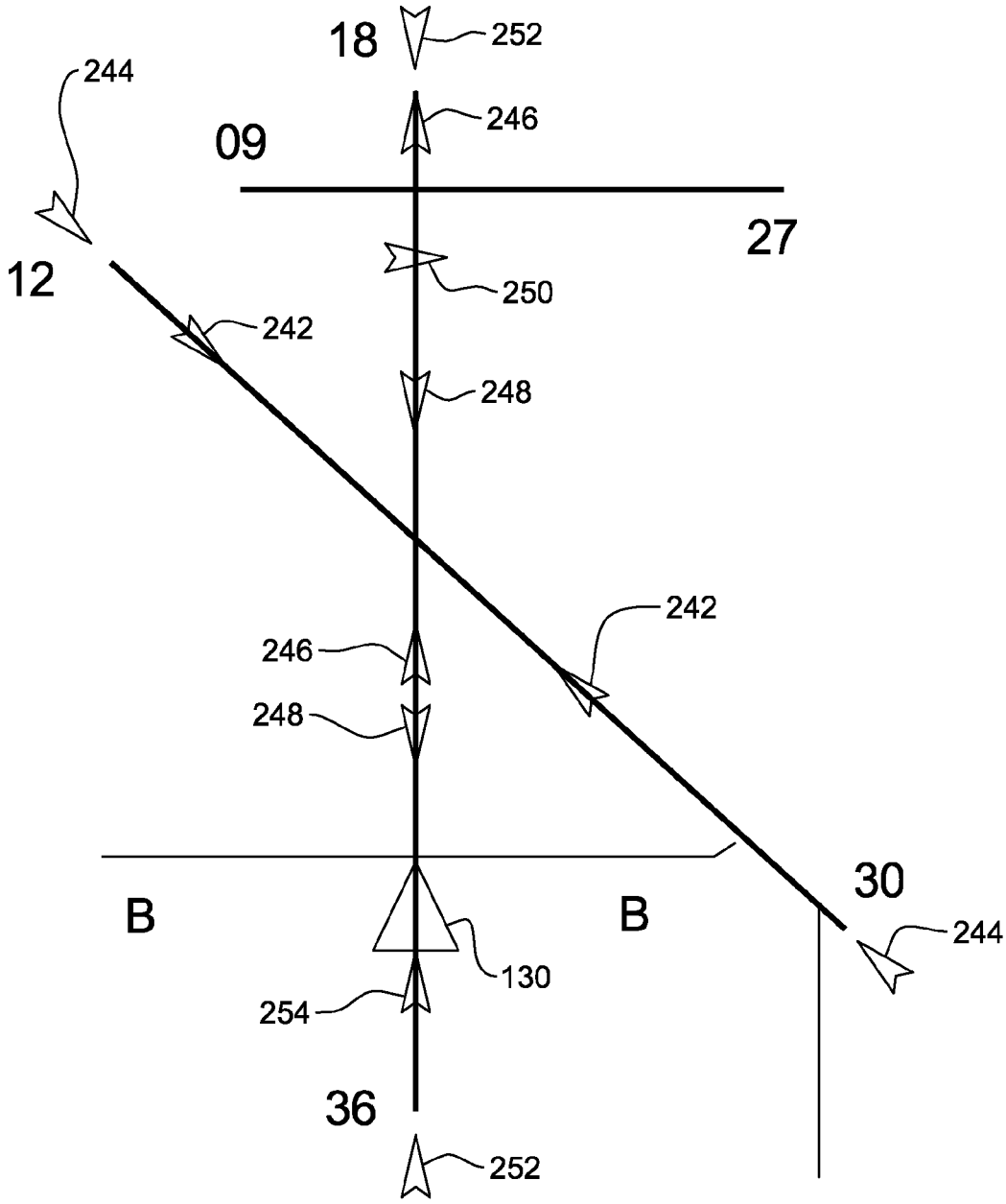

More generally, FIGS. 7A-B show off-scale traffic that triggers indications during ownship taxi on ownship runway 36. In this example, since runway 36 is not defined as a takeoff or landing runway, ownship taxi runway may therefore be identified by ownship in the runway box and aligned to within 30 degrees of the runway heading. Again, representative traffic is shown scattered at several airport locations including intersecting runways 12-30 or 09-27 and with all airport traffic shown currently off-scale. Taxiway traffic 230 on taxiway B is not of interest; nor is traffic 232 on distant (i.e., not the next) intersecting runway 09-27. Also, traffic 234 headed across next intersecting runway 12-30 and traffic 236 headed away from the intersection with runway 18-36 is not of interest. Neither is standing/taxi/takeoff traffic 238 that is behind ownship 130 and headed away or diverging from ownship. Nor is departing traffic 240 that is in the ownship 130 runway box, but is above some specified speed, and/or diverging from ownship, or airborne, or beyond the departure runway end, or more than some specified altitude above ground level.

Eliminating all traffic that is not relevant or of interest, as shown in FIG. 7B, other than traffic on or approaching ownship runway 18-36, the preferred system considers only traffic 242, 244 on the next intersecting runway 12-30. So, in this example, the preferred system considers intersecting (standing/taxiing/taking off/landing) traffic 242 on next intersecting runway 12-30 and traffic 244 on approach to next intersecting runway 12-30, relevant or of interest as well. Any traffic on ownship runway that is ahead of ownship 130 is of interest and, so triggers off-scale display indications. In particular, traffic of interest includes ownship taxi runway traffic 246 with the same heading, ownship taxi runway traffic 248 with the opposite heading, whether taking off, landing, standing or taxiing, and traffic 250 crossing ownship taxi runway. Also, traffic 252 on approach to ownship taxi runway 18-36 is of interest and triggers off-scale display indications, as does immediately following traffic 254. Again it should be noted that aircraft 242, 244, 246, 248, 250, 252 and 254 are not intended to indicate actual locations of aircraft during ownship taxi, but are merely representative of locations, headings, and states of relevant-traffic that trigger off-scale display indications. Similar logic may be used to filter display of on-scale traffic.

So, as shown in FIG. 7B with ownship 130 on ownship runway, off-scale traffic indication triggers for display of traffic 242, 244, 246, 248, 250, 252 and 254 of interest in the next intersecting runway that intersects ownship runway box and all traffic in ownship runway box as well, and off-scale traffic indication triggers are defined as:

{any traffic on ground or in air, and in same runway box, and ahead of ownship} OR {any traffic on ground, and in same runway box, and heading within 30 degrees of runway heading, and converging on ownship} OR {any traffic in air at a selected altitude (e.g., ≦750' agl), and in same runway box, and heading within 30° of runway or reciprocal (opposite direction) runway heading, and converging on ownship} OR {any traffic manually or automatically coupled or otherwise designated by ownship crew, ATC, or predefined logic}.

Figure 8:
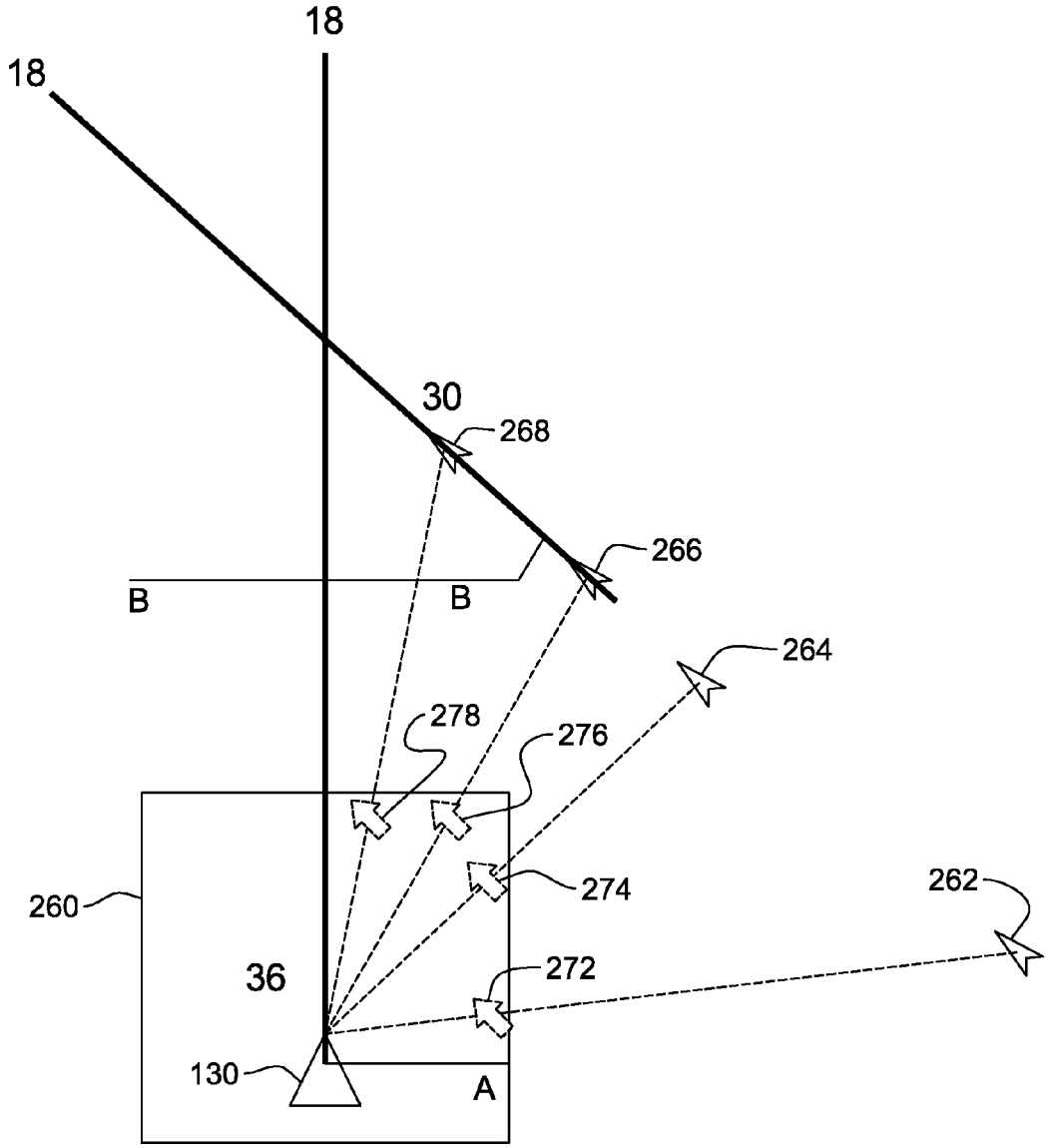
FIG. 8 shows an alternative approach to translating off-scale traffic indications.

FIG. 8 shows an example of an alternative approach to translating and displaying off-scale traffic indication according to an advantageous embodiment of the invention. This example shows ownship 130 on display 260 with an off-scale aircraft on approach 262, 264 to landing on runway 30, at landing 266 and after landing 268. This example shows a corresponding off-scale indication 272, 274, 276, 278 on display 260 for each off-scale position 262, 264, 266, and 268. Specifically, each off-scale indication 272, 274, 276, 278 is displayed on the same relative bearing from ownship 130 as each corresponding off-scale position 262, 264, 266, 268. As with the above examples, off-scale traffic indications 272, 274, 276, 278 may be colored to indicate in-air/on-ground state and specific information may be displayed with the indications 272, 274, 276, 278, e.g., traffic ID, speed, distance from intersection and time to intersection. Alternatively, the indications 272, 274, 276, 278 may include a time to conflict based on ownship and traffic speeds and distances from intersection. Also, instead of displaying off-scale indications 272, 274, 276, 278 based on a relative bearing from ownship 130, the off-scale indications 272, 274, 276, 278 may be located on a relative bearing from any selected display location, e.g., from center of display 260.

Figure 9:
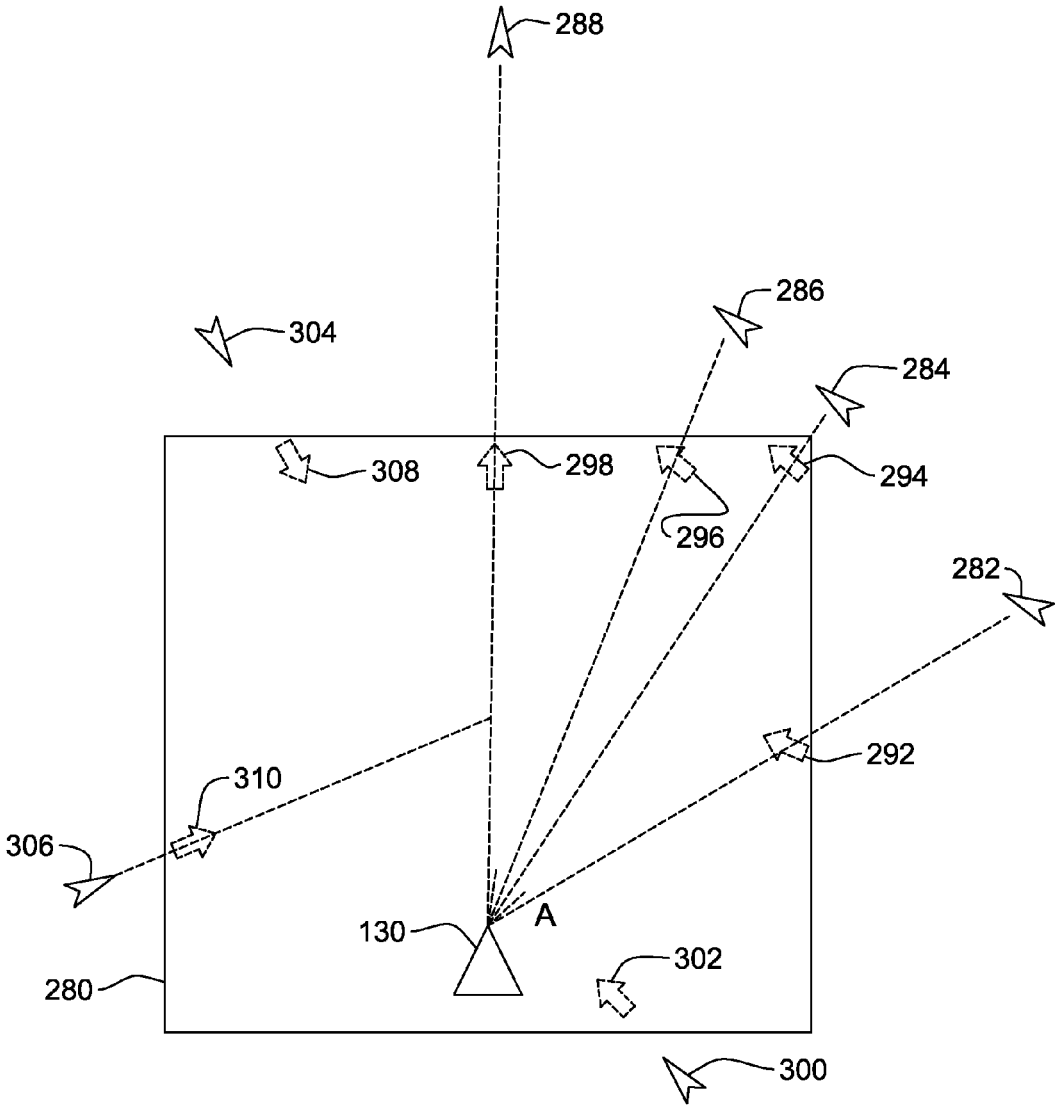
FIG. 9 illustrates shows an example of enroute and terminal area traffic and translating off-scale traffic indication.

FIG. 9 illustrates shows an example of enroute or terminal area traffic and translating off-scale traffic indication. This display 280 of this example shows ownship 130 and off-scale aircraft at locations 282, 284, 286 and 288 ahead of and merging with ownship 130. A corresponding off-scale indication 292, 294, 296, 298 is shown on display 280 displayed on the same relative bearing from ownship 130 as each corresponding off-scale position 282, 284, 286 and 288. Off-scale aircraft at location 300 is overtaking and conflicting with ownship 130 as indicated by corresponding off-scale indication 302. Off-scale aircraft at locations 304 and 306 are potential conflict aircraft and are indicated by corresponding off-scale indications 308 and 310. Optionally, as shown by aircraft/indication pairs 300/302, 304/308, and 306/310, the indication may be shown on a bearing from an expected intersection point, or from any selected display point. Traffic ground speeds may be included with each indication and provided relative to ownship or absolute. Similarly, traffic distances to ownship or ownship-traffic intersection point may be indicated. Moreover, times to ownship or ownship-traffic intersection point may be indicated.

Thus, advantageously on ground and in-flight, the present invention provides the flight crew with indications of off-scale traffic that is an actual or potential collision conflict, and with off-scale traffic that may be automatically or manually crew selected for additional information, or "coupled" with ownship, or otherwise designated as an aircraft the crew or predetermined logic has selected for additional information or awareness, or is an aircraft that is issuing, causing or may cause an alert, or is generating other types of relevant information. The present invention combines data/information on ownship and traffic with maps, including airport maps, map related database information, and pilot inputs to automatically and continuously evaluate traffic information received, e.g., by datalink, ADS-B (automatic dependent surveillance-broadcast) TIS-B (traffic information service-broadcast, or otherwise, to filter off-scale aircraft and identify traffic that is or may be relevant to safe and efficient ownship operation. The off-scale traffic indication may be graphical, alphanumeric, or a combination of graphical and alphanumeric, and may be accompanied by an aural indication, e.g., voice or tone. Further, the off-scale traffic indication may be accompanied by specific traffic information. Thus, the flight crew experiences enhanced awareness of off-scale traffic relevant to ownship operation to significantly reduce flight crew workload related to airport traffic monitoring, detection, and interpretation. Similarly, such logic and processing may be applied to on-scale traffic display filtering.

While the embodiments of the disclosure have been described in terms of preferred embodiments, those skilled in the art will recognize that the embodiments can be practiced with modification within the spirit and scope of the appended claims. It is intended that all such variations and modifications fall within the scope of the appended claims. Examples and drawings are, accordingly, to be regarded as illustrative rather than restrictive.

We claim:

1. A traffic display system comprising:

an ownship location finder determining ownship location;

a map storage storing maps including maps of a plurality of airports;

a traffic information collector collecting information on traffic in a selected area;

a local display displaying a map section of one of said stored maps for said selected area, said map section being for a selected range and selected by ownship location, said local display further mapping ownship at said ownship location on said map section and mapping all traffic within said section at respective collected locations; and an off-scale traffic processor monitoring traffic external to said map section as off-scale traffic and identifying of interest said off-scale traffic, said local display providing on said map section an indication of said of interest off-scale traffic, wherein each displayed said indication of off-scale traffic includes traffic type, traffic identification (ID), position, heading, speed, thrust, in-air/on-ground status, vehicle center of gravity (CG), pilot eye reference point (ERP), and taxi route.

2. A traffic display system as in claim 1, wherein said traffic display system is a flight deck traffic display system, said off-scale traffic processor identifies said traffic that is relevant-traffic from collected traffic information, relevant-traffic being within a selected relative altitude of ownship.

3. A flight deck traffic display system as in claim 2, wherein said relevant-traffic further includes only traffic identified as having groundspeed above a minimum.

4. A flight deck traffic display system as in claim 2, wherein said selected area is an airport and said off-scale traffic processor identifies runway and taxiway relevant-traffic headed towards an intersection with ownship heading and at least one of a runway-runway intersection, a runway-taxiway intersection, a taxiway-taxiway intersection, or a point in space as of interest.

5. A flight deck traffic display system as in claim 2, wherein said selected area is an airport and said off-scale traffic processor identifies a runway box for each runway with only relevant-traffic in a runway box being of interest.

6. A flight deck traffic display system as in claim 5, wherein said off-scale traffic processor identifies each said runway box with traffic on a corresponding runway having a heading aligned within a minimum angle of said corresponding runway.

7. A flight deck traffic display system as in claim 6, wherein said off-scale traffic processor identifies all relevant-traffic ahead of ownship in ownship said runway box as of interest.

8. A flight deck traffic display system as in claim 2, wherein said selected area is an airport and during ownship approach and landing said off-scale traffic processor identifies all intersecting runway relevant-traffic headed towards an intersection with ownship runway as of interest.

9. A flight deck traffic display system as in claim 1, wherein said each displayed indication further includes altitude, track, acceleration, distance from ownship, distance from intersection with ownship, time from ownship, time from intersection with ownship, and takeoff/landing runway.

10. A flight deck traffic display system as in claim 1, wherein said each displayed indication visibly indicates status of respective said off-scale traffic.

11. A flight deck traffic display system as in claim 1, wherein each off-scale traffic said indication of off-scale traffic on an on-scale runway is provided at said on-scale runway and each off-scale traffic said indication of off-scale traffic on an off-scale runway is provided at a display corner closest to the respective off-scale traffic relative to ownship.

12. An aircraft flight deck comprising a display as in claim 1.

13. A traffic display system as in claim 1, wherein the map storage further stores airport map runway-runway intersection points, runway-taxiway intersection points, taxiway-taxiway intersection points, gate and hold line location information, ILS protected area information, Land & Hold Short locations, Automatic Terminal Information Services (ATIS) information, and NOtices To AirMen (NOTAM) information.

14. A flight deck traffic display system as in claim 1, wherein said selected area is an airspace volume.

15. A flight deck traffic display system as in claim 2, wherein said relevant-traffic further includes only traffic identified as within a specified horizontal distance of ownship.

16. A flight deck traffic display system as in claim 2, wherein said relevant-traffic further includes only traffic identified as on a path converging or potentially converging with at least one of ownship, ownship track, extended ownship heading line, or ownship.

17. A flight deck traffic display system as in claim 2, wherein said relevant-traffic further includes only traffic identified as at least one of coupled with ownship to provide ownship guidance information or selected for traffic information.

18. A flight deck traffic display system as in claim 2, wherein said relevant-traffic includes aircraft, ground vehicles, pedestrians, construction equipment, and obstacles.

19. A flight deck traffic display system as in claim 2, wherein said relevant-traffic is traffic being below a selected maximum altitude Above Ground Level (AGL).

20. A flight deck traffic display system as in claim 2, wherein said selected area is an airport and said off-scale traffic processor identifies runway and taxiway traffic that is converging or potentially converging on an intersection with ownship or ownship path, track, or extended heading line as of interest.

21. A method of displaying traffic, said method comprising:

collecting information on ownship location;

mapping said ownship location on an area map;

displaying a segment of said area map, said segment including the mapped said ownship location;

collecting local traffic information, local traffic within said displayed segment being mapped on said displayed segment, remaining said local traffic being off-scale traffic;

identifying of interest off-scale traffic; and using a processor for providing an indication on said display of identified said of interest off-scale traffic, wherein displayed said traffic is airport traffic and when said indication of off-scale traffic is provided for traffic on an off-scale runway, providing said indication further comprises locating said indication at a display corner closest to the respective off-scale traffic relative to ownship.

22. A method as in claim 21, wherein the step of identifying of interest off-scale traffic comprises identifying relevant-traffic, relevant-traffic being within a selected relative altitude of ownship.

23. A method as in claim 22, wherein displayed said traffic is airport traffic and the step of identifying of interest off-scale traffic comprises identifying runway and taxiway relevant-traffic headed towards an intersection with ownship heading and at least one of a runway-runway intersection, a runway-taxiway intersection, a taxiway-taxiway intersection, or a point in space.

24. A method as in claim 22, wherein displayed said traffic is airport traffic and the step of identifying of interest off-scale traffic comprises identifying a runway box for each runway, and identifying only relevant-traffic in each said runway box.

25. A method as in claim 24, wherein the step of identifying of interest off-scale traffic comprises identifying each said runway box with relevant-traffic having a heading aligned within a minimum angle of said corresponding runway.

26. A method as in claim 25, wherein the step of identifying of interest off-scale traffic comprises identifying all relevant-traffic ahead of ownship in ownship said runway box.

27. A method as in claim 25, wherein the step of identifying of interest off-scale traffic comprises identifying all relevant-traffic ahead of ownship when ownship is in, and aligned within a selected angle of, said runway box.

28. A method as in claim 22, wherein displayed said traffic is airport traffic and during ownship takeoff, approach and landing the step of identifying of interest off-scale traffic comprises identifying all intersecting runway relevant-traffic headed towards an intersection with ownship runway.

29. A method as in claim 22, wherein displayed said traffic is airport traffic and during ownship taxi the step of identifying of interest off-scale traffic comprises identifying at least one of the next or subsequent intersecting runway relevant-traffic converging on an intersection ahead of ownship.

30. A method as in claim 22, wherein said relevant-traffic is traffic identified as being below a selected maximum altitude above ground level (agl).

31. A method as in claim 21, wherein displayed said traffic is airport traffic and the step of providing said indication of off-scale traffic comprises displaying corresponding traffic type, traffic identification (ID), position, heading, speed, thrust, in-air/on-ground status, vehicle center of gravity (CG), pilot eye reference point (ERP), and taxi route.

32. A method as in claim 29, the step of providing said indication of off-scale relevant-traffic further comprising visibly indicating status of respective said off-scale traffic.

33. A method as in claim 21, wherein displayed said traffic is airport traffic and when said indication of off-scale traffic is provided for traffic on an on-scale runway, the step of providing said indication further comprises locating said indication at said on-scale runway.

34. A method as in claim 21, wherein displayed said traffic is airport traffic and when said indication of off-scale traffic is provided for traffic, the step of providing said indication further comprises locating said indication at the intersection of the display edge and a line drawn from at least one of ownship to the off-scale traffic, the display center to the off-scale traffic, the intersection point of ownship and traffic tracks, or some other selected display location to the off-scale traffic.

35. An aircraft including a display in a traffic display system in a cockpit, said traffic display system comprising:

an ownship location finder determining ownship location;

a map storage storing maps including a plurality of airport maps;

a traffic information collector collecting information on traffic and identifying any said traffic within a selected volume of airspace as relevant-traffic;

a local display displaying a map section of one of said stored maps selected by ownship location, said map section being for a selected range, said local display further mapping ownship at said ownship location on said map section and mapping all traffic within said section at respective collected locations; and an off-scale traffic processor monitoring traffic external to said map section as off-scale traffic, and identifying a runway box for each runway and of interest said off-scale traffic from said relevant-traffic in any said runway box, said local display providing on said map section an indication of said of interest off-scale traffic, wherein said off-scale traffic processor identifies each said runway box with traffic on a corresponding runway having a heading aligned to within a minimum angle of said corresponding runway and all relevant-traffic ahead of ownship in ownship said runway box as of interest.

36. An aircraft as in claim 35, wherein said off-scale traffic processor identifies runway relevant-traffic headed towards an intersection with ownship heading as of interest.

37. An aircraft as in claim 35, wherein during ownship takeoff, approach and landing said off-scale traffic processor identifies all intersecting runway relevant-traffic headed towards an intersection ahead of and on ownship runway as of interest.

38. An aircraft as in claim 35, wherein each displayed said indication visibly indicates status of respective said off-scale traffic and includes traffic type, traffic identification (ID), position, heading, speed, thrust, in-air/on-ground status, vehicle center of gravity (CG), pilot eye reference point (ERP), and taxi route.

39. An aircraft as in claim 35, wherein each off-scale traffic said indication of off-scale traffic on an on-scale runway is provided at said on-scale runway and each off-scale traffic said indication of off-scale traffic on an off-scale runway is provided at a display corner closest to the respective off-scale traffic relative to ownship.

40. An aircraft as in claim 35, wherein said relevant-traffic further includes only traffic having groundspeed above a minimum.

41. An aircraft as in claim 35, wherein said relevant-traffic is on-ground traffic and traffic with an altitude $\leqq$750' above ground level (agl).

42. A flight deck traffic display system comprising:

an ownship location finder determining ownship location;

a map storage storing maps including maps of a plurality of airports;

a traffic information collector collecting information on traffic in a selected area;

a local display displaying a map section of one of said stored maps for said selected area, said selected area being an airport, said map section being for a selected range and selected by ownship location, said local display further mapping ownship at said ownship location on said map section and mapping all traffic within said section at respective collected locations; and an off-scale traffic processor monitoring traffic external to said map section as off-scale traffic and identifying a runway box for each runway and of interest said off-scale traffic, said local display providing on said map section an indication of said of interest off-scale traffic, wherein said off-scale traffic processor identifies said traffic that is relevant-traffic from collected traffic information, relevant-traffic being within a selected relative altitude of ownship and in a runway box, and wherein said off-scale traffic processor identifies each said runway box with traffic on a corresponding runway having a heading aligned within a minimum angle of said corresponding runway.

43. A traffic display system comprising:

an ownship location finder determining ownship location;

a map storage storing maps including maps of a plurality of airports;

a traffic information collector collecting information on traffic in a selected area;

a local display displaying a map section of one of said stored maps for said selected area, said map section being for a selected range and selected by ownship location, said local display further mapping ownship at said ownship location on said map section and mapping all traffic within said section at respective collected locations; and an off-scale traffic processor monitoring traffic external to said map section as off-scale traffic and identifying of interest said off-scale traffic, said local display providing on said map section an indication of said of interest off-scale traffic, wherein each off-scale traffic said indication of off-scale traffic on an on-scale runway is provided at said on-scale runway and each off-scale traffic said indication of off-scale traffic on an off-scale runway is provided at a display corner closest to the respective off-scale traffic relative to ownship.

44. A flight deck traffic display system comprising:

an ownship location finder determining ownship location;

a map storage storing maps including maps of a plurality of airports;

a traffic information collector collecting information on traffic in a selected area;

a local display displaying a map section of one of said stored maps for said selected area, said map section being for a selected range and selected by ownship location, said local display further mapping ownship at said ownship location on said map section and mapping all traffic within said section at respective collected locations; and an off-scale traffic processor monitoring traffic external to said map section as off-scale traffic and identifying of interest said off-scale traffic, said local display providing on said map section an indication of said of interest off-scale traffic, wherein said traffic display system is a traffic display system, said off-scale traffic processor identifies said traffic that is relevant-traffic from collected traffic information, relevant-traffic being within a selected relative altitude of ownship, said relevant-traffic further including only traffic identified as on a path converging or potentially converging with at least one of ownship, ownship track, extended ownship heading line, or ownship.

45. A method of displaying airport traffic, said method comprising:

collecting information on ownship location;

mapping said ownship location on an area map;

displaying a segment of said area map, said segment including the mapped said ownship location;

collecting local traffic information, local traffic within said displayed segment being mapped on said displayed segment, remaining said local traffic being off-scale traffic;

using a processor for identifying of interest off-scale traffic comprising a runway box for each runway and identifying only relevant-traffic in each said runway box, relevant-traffic being within a selected relative altitude of ownship; wherein identifying of interest off-scale traffic further comprises identifying each said runway box with relevant-traffic having a heading aligned within a minimum angle of said corresponding runway; and providing an indication on said display of identified said of interest off-scale traffic.

46. A method of displaying airport traffic, said method comprising:

collecting information on ownship location;

mapping said ownship location on an area map;

displaying a segment of said area map, said segment including the mapped said ownship location;

collecting local traffic information, local traffic within said displayed segment being mapped on said displayed segment, remaining said local traffic being off-scale traffic;

identifying of interest off-scale traffic; and providing an indication on said display of identified said of interest off-scale traffic, providing said indication further comprising locating said indication at the intersection of the display edge and a line drawn from at least one of ownship to the off-scale traffic, the display center to the off-scale traffic, the intersection point of ownship and traffic tracks, or some other selected display location to the off-scale traffic.

47. An aircraft including a display in a traffic display system in a cockpit, said traffic display system comprising:

an ownship location finder determining ownship location;

a map storage storing maps including a plurality of airport maps;

a traffic information collector collecting information on traffic and identifying any said traffic within a selected volume of airspace as relevant-traffic;

a local display displaying a map section of one of said stored maps selected by ownship location, said map section being for a selected range, said local display further mapping ownship at said ownship location on said map section and mapping all traffic within said section at respective collected locations; and an off-scale traffic processor monitoring traffic external to said map section as off-scale traffic, and identifying a runway box for each runway and of interest said off-scale traffic from said relevant-traffic in any said runway box, said local display providing on said map section an indication of said of interest off-scale traffic, wherein each displayed said indication visibly indicates status of respective said off-scale traffic and includes traffic type, traffic identification (ID), position, heading, speed, thrust, in-air/on-ground status, vehicle center of gravity (CG), pilot eye reference point (ERP), and taxi route.

* * * * *